US012398542B1

(12) United States Patent
Fukuda

(10) Patent No.: US 12,398,542 B1
(45) Date of Patent: Aug. 26, 2025

(54) WORKING VEHICLE AND ATTACHMENT USAGE SYSTEM

(71) Applicant: KUBOTA CORPORATION, Osaka (JP)

(72) Inventor: Yuji Fukuda, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 82 days.

(21) Appl. No.: 18/588,086

(22) Filed: Feb. 27, 2024

(51) Int. Cl.
*E02F 9/26* (2006.01)

(52) U.S. Cl.
CPC ..... *E02F 9/265* (2013.01)

(58) Field of Classification Search
CPC ..... E02F 9/265
See application file for complete search history.

(56) References Cited

U.S. PATENT DOCUMENTS 10,351,061 B1 * 7/2019 Chaudhari ..... B60R 1/003
2022/0412040 A1 12/2022 Zitterbart et al.
2024/0424844 A1 * 12/2024 Roltgen ..... B60D 1/52

* cited by examiner

*Primary Examiner* — Ashley L Redhead, Jr.
(74) *Attorney, Agent, or Firm* — Keating & Bennett, LLP

(57) ABSTRACT

A controller of a working vehicle is configured or programmed to, while a latching mechanism is in an unlatching state in which the latching mechanism does not latch an attachment and at least one of a traveling device or a working device is about to take action or is in action, select wireless signal(s) satisfying a first condition from wireless signal(s) transmitted from transmitter(s) in or on attachment(s) and received by a receiver, and provisionally select piece(s) of identification information included in the selected wireless signal(s), and once the latching mechanism has entered a latching state in which the latching mechanism latches the attachment, definitively select a piece of identification information which satisfies a second condition from the provisionally selected piece(s) of identification information, and start a predetermined process based on the definitively selected piece of identification information.

15 Claims, 21 Drawing Sheets

Fig.3

| |
|---|
| ADV information (attachment ID, vibration information, time information, RSSI, etc.) |
| ADV information (attachment ID, vibration information, time information, RSSI, etc.) |
| ADV information (attachment ID, vibration information, time information, RSSI, etc.) |
| ⋮ |

Fig.4

| |
|---|
| Provisional selection information (attachment ID,time information, RSSI, etc.) |
| Provisional selection information (attachment ID,time information, RSSI, etc.) |
| Provisional selection information (attachment ID,time information, RSSI, etc.) |
| ⋮ |

Fig.5

| Attachment ID | Display data |
| --- | --- |
| ATT0001 | Name<br>Specifications<br>Icon etc. |
| ATT0002 | Name<br>Specifications<br>Icon etc. |
| ATT0003 | Name<br>Specifications<br>Icon etc. |
| ⋮ | ⋮ |

Fig.6

| Attachment ID | Control data<br>Amount of supply of hydraulic fluid |
|---|---|
| ATT0001 | None |
| ATT0002 | Small |
| ATT0003 | Large |
| ⋮ | ⋮ |

L1

| Name | Attachment ID | Specifications |
|---|---|---|
| Bucket | ATT0001 | Excavation, Large, Total length, Total width, etc. |
| Spreader | ATT0002 | Spreading, Total length, Total width, etc. |
| Skid cutter | ATT0003 | Mowing, Small, Total length, Total width, etc. |
| Pallet fork | ATT00xy | Cargo handling, Total length, Total width, etc. |
| Bucket | ATT00xx | Excavation, Small, Total length, Total width, etc. |
| | ⋮ | ⋮ |

Fig.13

L2

| Provisionally selected attachment | Attachment ID | Specifications |
|---|---|---|
| Bucket | ATT0001 | Excavation, Large, Total length, Total width, etc. |
| Skid cutter | ATT0003 | Mowing, Small, Total length, Total width, etc. |

Fig.16

WORKING VEHICLE AND ATTACHMENT USAGE SYSTEM

BACKGROUND OF THE INVENTION

1. Field of the Invention

The present invention relates to techniques to use attachments on working vehicles.

2. Description of the Related Art

For example, the specification of U.S. Patent Application Publication No. 2022/412040 discloses a system to automatically identify the attachment attached to a working vehicle among attachments in the vicinity of the working vehicle. The system is such that a first communication unit (tool module) including a first acceleration sensor is provided on an attachment such as a bucket, a quick changer configured to quickly and simply attach and detach the attachment thereto and therefrom is provided at the distal end of the boom of the working vehicle (excavator), a second communication unit (receiving module) including a second acceleration sensor is provided at the quick changer, and the working vehicle is provided with an identification module and a controller.

The first communication unit transmits, to the second communication unit via a near field communication such as RFID or Bluetooth (registered trademark) Low Energy, a first acceleration signal relating to the instantaneous acceleration of the attachment detected by the first acceleration sensor and an identifying signal of the attachment. The second communication unit transmits, to the identification module, the first acceleration signal and the identifying signal received from the first communication unit and the second acceleration signal relating to the instantaneous acceleration of the quick changer detected by the second acceleration sensor. The identification module identifies the attachment attached to the quick changer based on the comparison (e.g., difference) between the first acceleration signal and the second acceleration signal received from the second communication unit, and transmits the identification information relating to the attachment to the controller. The controller performs an appropriate operation (work action) of the working vehicle based on the received identifying signal.

When an attachment is about to be attached to the working vehicle via a hitch such as a quick changer, the user of the working vehicle causes the working vehicle to move forward toward the attachment and/or raises or lowers the boom. In so doing, the attachment and the hitch may vibrate in different manners depending on the structures of the attachment and the hitch and the user's skill, etc. There may be also cases in which radio waves (wireless signal) transmitted from the first communication unit are temporarily blocked by a metal attachment, hitch, or boom, etc. and the second communication unit hardly receives the radio waves. In such cases, the working vehicle cannot perform a predetermined process corresponding to the attached attachment, making it impossible to use the attachment appropriately.

SUMMARY OF THE INVENTION

Example embodiments of the present invention make it possible to use an attachment appropriately on a working vehicle.

A working vehicle according to an aspect of an example embodiment of the present invention includes a traveling device and a working device which are on a vehicle body, a hitch connected to the working device to attach and detach an attachment thereto and therefrom, a receiver to receive one or more wireless signals which are: (i) transmitted periodically from one or more transmitters in or on one or more of the attachments, (ii) include respective one or more pieces of identification information relating to the one or more attachments, and (iii) are compliant with a near field communication standard, and a controller, wherein the hitch includes a latching mechanism selectively operable in a latching state in which the attachment is secured to the hitch or an unlatching state in which the attachment is not secured to the hitch, and the controller is configured or programmed to, while the latching mechanism is in the unlatching state and at least one of the traveling device or the working device is about to take action or is in action, select one or more wireless signals which satisfy a first condition from the one or more wireless signals received by the receiver, and provisionally select one or more pieces of identification information of the one or more pieces of identification information that are included in the selected one or more wireless signals, and once the latching mechanism has entered the latching state, definitively select a piece of identification information, which satisfies a second condition, from the provisionally selected one or more pieces of identification information, and start a predetermined process based on the definitively selected piece of identification information.

An attachment usage system according to an aspect of an example embodiment of the present invention is a system to use the one or more attachments on the working vehicle, and includes the traveling device, the working device, the hitch, the transmitter, the receiver, and the controller. The controller may be provided somewhere other than the working vehicle.

The controller may be configured or programmed to, while the latching mechanism is in the unlatching state, if the receiver does not receive the one or more wireless signals which satisfy the first condition and which include the provisionally selected one or more pieces of identification information for a predetermined period of time or more, deselect the provisionally selected one or more pieces of identification information.

The controller may be configured or programmed to, while the latching mechanism is in the unlatching state and an action speed of the traveling device is equal to or greater than a predetermined value, if the receiver does not receive the one or more wireless signals which satisfy the first condition and which include the provisionally selected one or more pieces of identification information for a predetermined period of time or more, deselect the provisionally selected one or more pieces of identification information.

The controller may be configured or programmed to, if the provisionally selected one or more pieces of identification information include only a single piece of identification information, definitively select the single piece of identification information once the latching mechanism has entered the latching state.

The controller may be configured or programmed to cause a memory to store the one or more pieces of identification information included in the one or more wireless signals received by the receiver, and once the latching mechanism has entered the latching state, select a piece of identification information which satisfies a third condition from one or more of the one or more pieces of identification information that were stored in the memory during a predetermined period of time which ended when the latching mechanism entered the latching state, and, if the selected piece of identification information matches one of the provisionally selected one or more pieces of identification information, start the predetermined process based on the one of the provisionally selected one or more pieces of identification information.

The controller may be configured or programmed to, if the selected piece of identification information which satisfies the third condition does not match any of the provisionally selected one or more pieces of identification information, start the predetermined process based on the selected piece of identification information which satisfies the third condition.

The controller may be configured or programmed to, if the controller fails to select any piece of identification information which satisfies the third condition, definitively select a piece of identification information which satisfies the second condition from the provisionally selected one or more pieces of identification information.

The working vehicle may further include a user interface. The controller may be configured or programmed to, if the controller fails to select any piece of identification information which satisfies the third condition, cause the user interface to output one or more pieces of attachment information relating to one or more of the one or more attachments that correspond to the provisionally selected one or more pieces of identification information, and once a piece of attachment information has been selected from the one or more pieces of attachment information via the user interface, start the predetermined process based on the selected piece of attachment information.

The controller may be configured or programmed to cause a memory to store the one or more pieces of identification information included in the one or more wireless signals received by the receiver, and once the latching mechanism has entered the latching state when none of the one or more pieces of identification information are provisionally selected, select a piece of identification information which satisfies a third condition from one or more of the one or more pieces of identification information that were stored in the memory during a predetermined period of time which ended when the latching mechanism entered the latching state, and start the predetermined process based on the selected piece of identification information.

The controller may be configured or programmed to, once the latching mechanism has entered the latching state when none of the one or more pieces of identification information are provisionally selected and the controller has failed to select any piece of identification information which satisfies the third condition from one or more of the one or more pieces of identification information that were stored in the memory during the predetermined period of time which ended when the latching mechanism entered the latching state, cause the user interface to output prompt information asking for input of a piece of attachment information relating to the attachment attached to the hitch, and once the piece of attachment information has been inputted via the user interface, start the predetermined process based on the inputted piece of attachment information.

The working vehicle may further include a work operator to be operated to actuate the working device. The controller may be configured or programmed to provisionally select the one or more pieces of identification information if (i) the latching mechanism is in the unlatching state and (ii) the work operator is operated for a period of time or more and/or the working device is in action for the period of time or more.

The working vehicle may further include a travel operator to be operated to actuate the traveling device. The controller may be configured or programmed to provisionally select the one or more pieces of identification information if (i) the latching mechanism is in the unlatching state and (ii) the travel operator is operated for a period of time or more and/or the traveling device is in action for the period of time or more.

The controller may be configured or programmed to provisionally select the one or more pieces of identification information if (i) the latching mechanism is in the unlatching state and (ii) at least one of the traveling device or the working device is performing a predetermined action to attach the attachment to the hitch.

Each of the one or more transmitters may be a beacon transmitter to transmit an advertisement signal including a corresponding piece of identification information relating to a corresponding attachment in or on which the transmitter is provided. The receiver may be a beacon scanner to receive the advertisement signal.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

FIG. 3 illustrates ADV information stored in an internal memory.

FIG. 4 illustrates provisional selection information stored in a nonvolatile memory.

FIG. 5 is a diagram showing an example of the relationship between attachment IDs and their corresponding pieces of display data.

FIG. 6 is a diagram showing an example of the relationship between attachment IDs and their corresponding pieces of control data.

FIG. 13 illustrates an example of an attachment list.

FIG. 16 illustrates an example of a provisional selection list.

DETAILED DESCRIPTION OF THE EXAMPLE EMBODIMENTS

Figure 1:
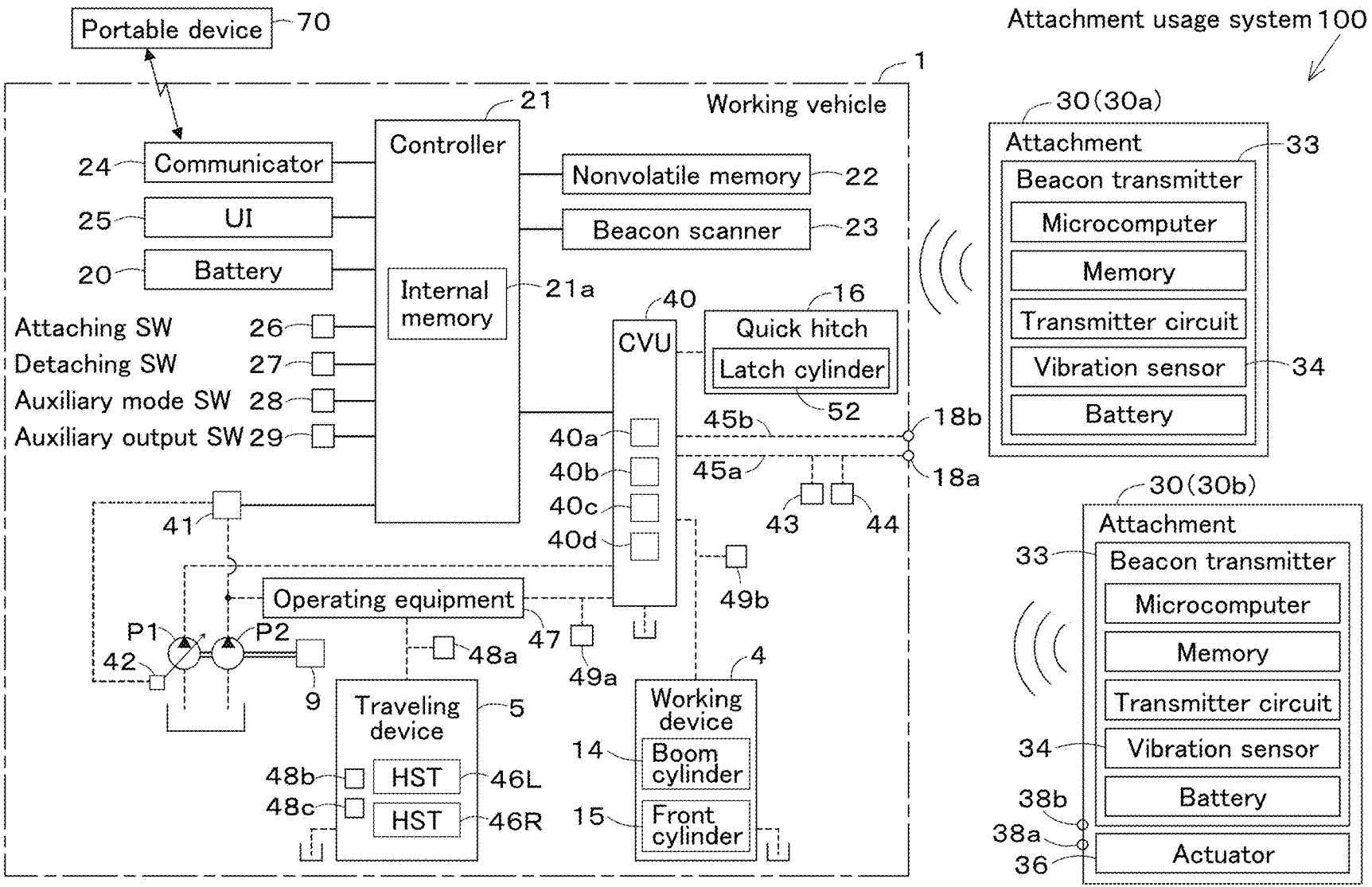
FIG. 1 is a block diagram of an attachment usage system and a working vehicle.

The example embodiments will now be described with reference to the accompanying drawings, wherein like reference numerals designate corresponding or identical elements throughout the various drawings. The drawings are to be viewed in an orientation in which the reference numerals are viewed correctly.

The following description discusses example embodiments of the present invention with reference to the drawings as needed.

Figure 17:
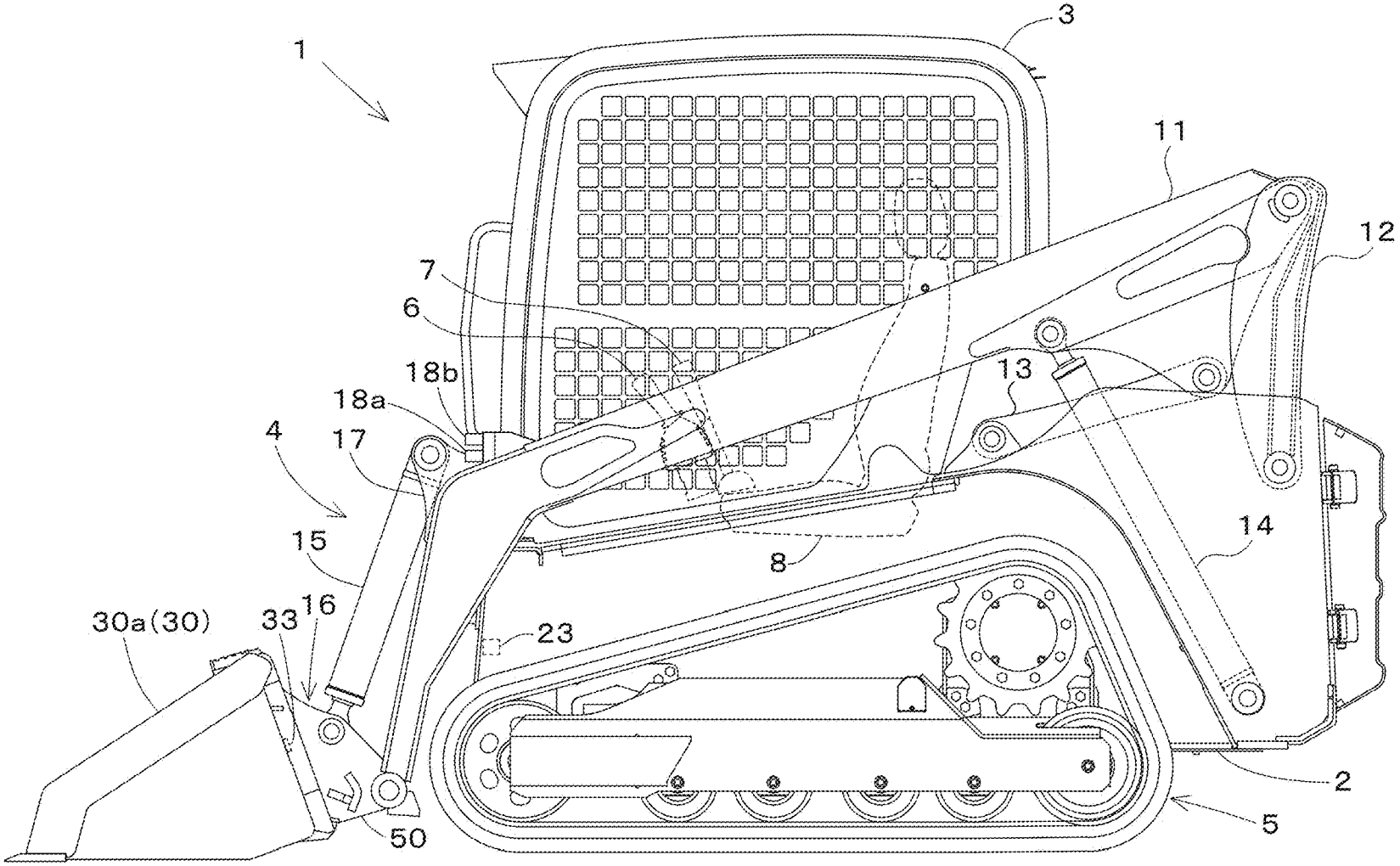
FIG. 17 is a side view of a working vehicle.

FIG. 17 is a side view of a working vehicle 1 according to the present example embodiment. In the present example embodiment, a compact track loader is discussed as an example of the working vehicle 1. Note, however, that the working vehicle according to an example embodiment of the present invention is not limited to a compact track loader, and may be, for example, some other construction machine or agricultural machine such as a skid-steer loader, a backhoe, or a tractor.

The working vehicle 1 includes a vehicle body 2, a cabin 3, a working device 4, and traveling device(s) 5. The cabin 3 is provided on the vehicle body 2. The cabin 3 includes a seat 8, operators (manual operators) to be operated by a user seated on the seat 8, and/or the like. The operators include a travel operator 6 to be operated to actuate the traveling devices 5 and a work operator 7 to be operated to actuate the working device 4.

The traveling devices 5 are provided on the left and right sides of the vehicle body 2 and support the vehicle body 2 such that the vehicle body 2 is allowed to travel. The traveling devices 5 are crawler traveling devices. The user operates the travel operator 6 to cause both the left and right traveling devices (the traveling device on the left side and the traveling device on the right side) 5 to rotate in a forward direction, both the left and right traveling devices 5 to rotate in a reverse direction, only one of the left and right traveling devices 5 to rotate in the forward direction, or one of the left and right traveling devices 5 to rotate in the forward direction and the other to rotate in the reverse direction to cause the vehicle body 2 (working vehicle 1) to travel forward, rearward, or turn left or right. The travel operator 6 can be operated in operation states corresponding to forward travel, rearward travel, left turn, right turn, and stop of the traveling devices 5.

The working device 4 is attached to the vehicle body 2. The working device 4 includes a bucket 30*a*, boom(s) 11, lift link(s) 12, control link(s) 13, boom cylinder(s) 14, front cylinder(s) 15, and a quick hitch 16. The booms 11, the lift links 12, the control links 13, the boom cylinders 14, and the front cylinders 15 are provided at the left and right of the cabin 3. The left and right booms 11 are connected to each other by a connector 17 at an intermediate portion of their front portion. The left boom 11 has, at the front portion thereof, a hydraulic fluid outlet port (power output port) 18*a* and a hydraulic fluid inlet port 18*b*.

The lift links 12 and the control links 13 support proximal portions (rear portions) of the booms 11 via shafts such that the booms 11 are swingable up and down. The boom cylinders 14 each have one end thereof pivotally connected to a corresponding one of the booms 11 via a shaft and the other end thereof pivotally connected to a lower rear portion of the vehicle body 2 via a shaft. Upon operation of the work operator 7 along a first direction by the user of the working vehicle 1, the boom cylinders 14 extend or retract and the booms 11 ascend or descend (swing upward or downward).

The booms 11 are provided with the quick hitch 16 at the distal ends thereof. The quick hitch 16 is a linkage configured to easily attach and detach any of various attachments (hydraulic driven working tools) 30 such as the bucket 30*a*. The user of the working vehicle 1 can easily change attachments 30 using the quick hitch 16. The quick hitch 16 is therefore also called "quick changer". In the example shown in FIG. 17, the bucket 30*a* which is an example of the attachment 30 is attached to a front portion of the quick hitch 16.

The quick hitch 16 has, connected to a rear portion thereof, the distal ends of the booms 11 and ends of the front cylinders 15 via respective shafts such that the booms 11 and the front cylinders 15 are pivotable. The opposite ends of the front cylinders 15 are pivotally connected to the connector 17 via shafts. Upon operation of the work operator 7 along a second direction, the front cylinders 15 extend or retract and the quick hitch 16 swings upward or downward. With this, the bucket 30*a* attached to the quick hitch 16, swinging upward or downward, performs shoveling or dumping.

Figure 18:
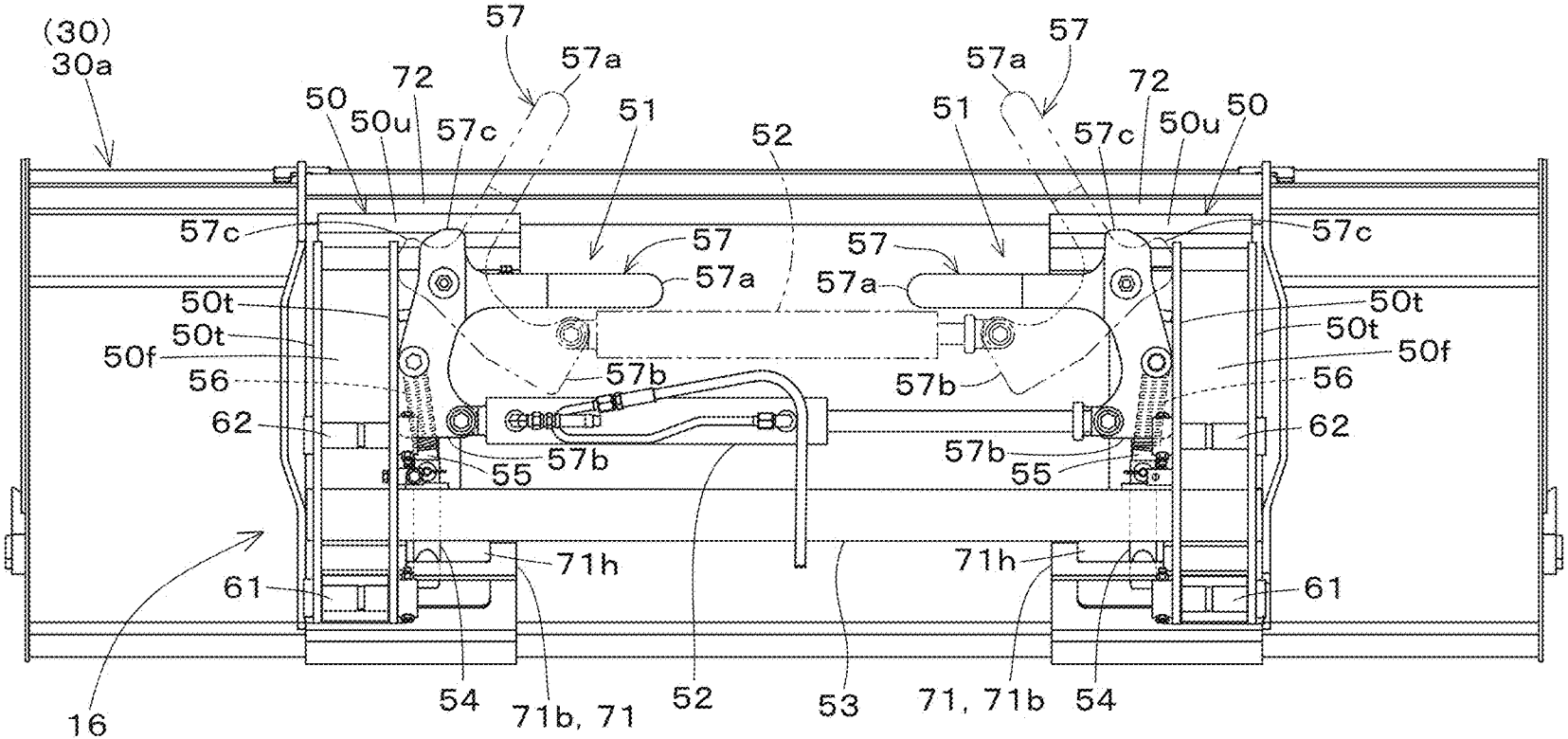
FIG. 18 is an elevational view of a quick hitch.
Figure 19A:
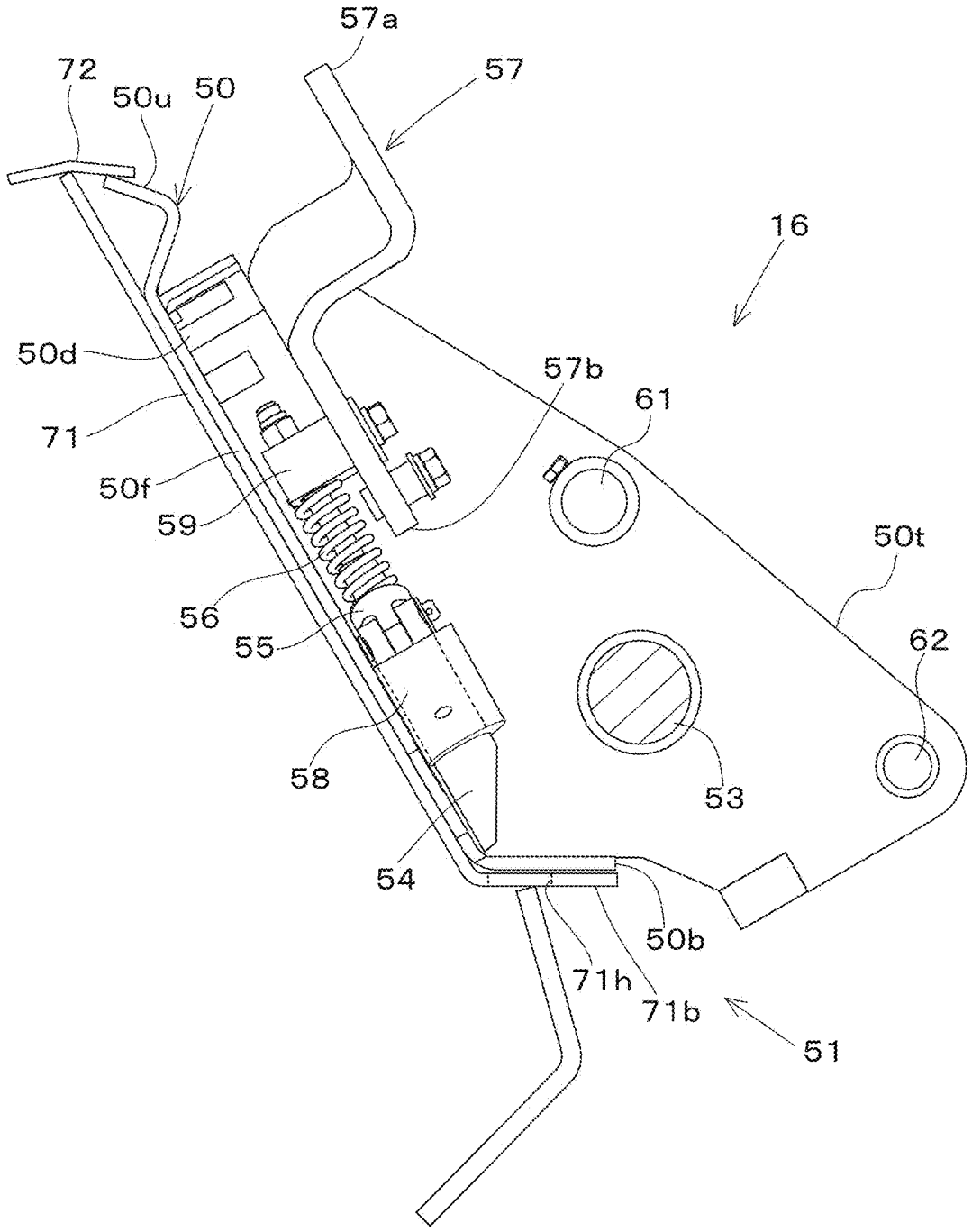
FIG. 19A is a side view of an attachment unlatched by a quick hitch.
Figure 19B:
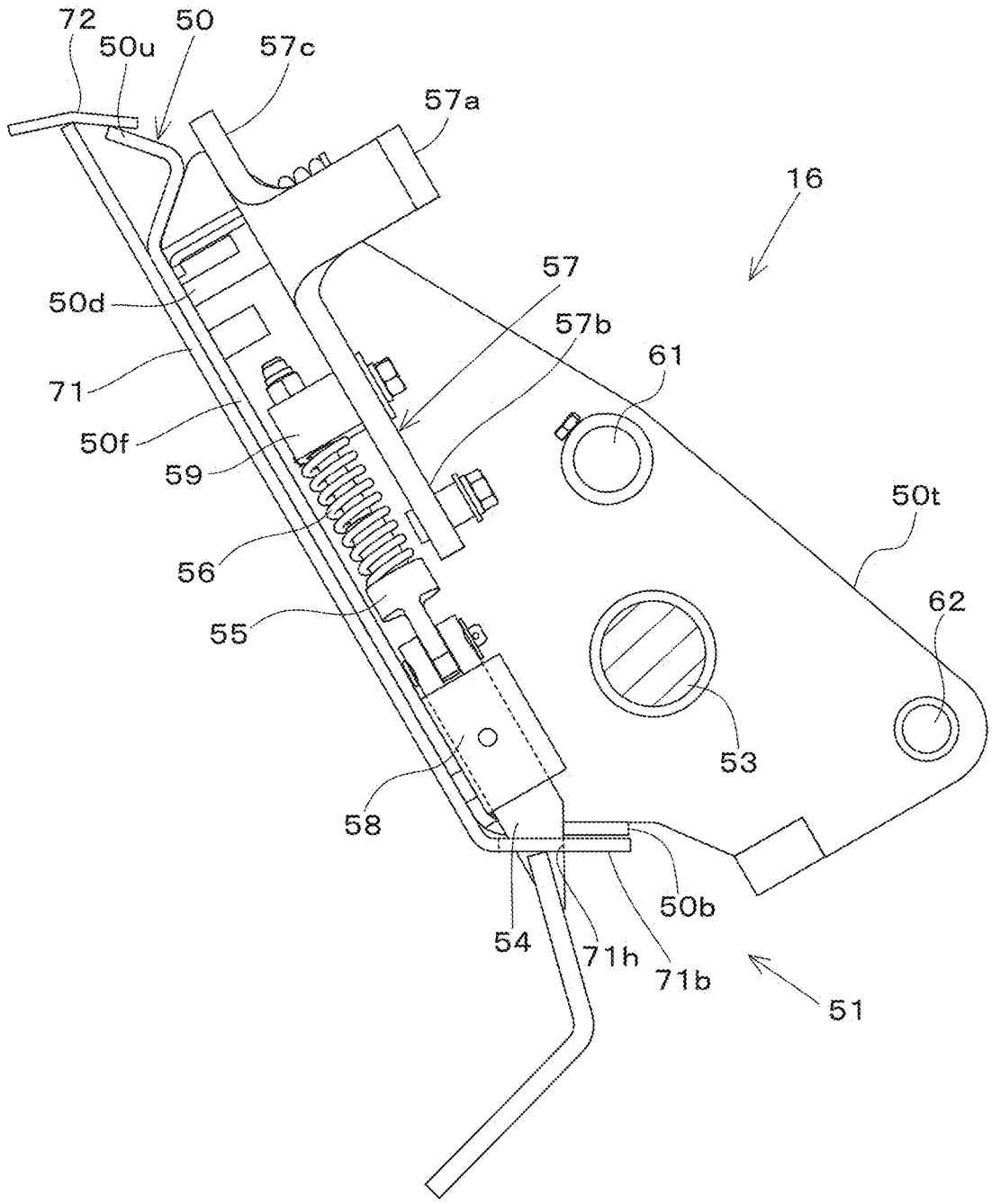
FIG. 19B is a side view of an attachment latched by a quick hitch.

FIG. 18 is an elevational view of the quick hitch 16. Specifically, FIG. 18 illustrates the quick hitch 16 in FIG. 17 as viewed from the vehicle body 2 of the working vehicle 1. FIG. 19A is a side view of an attachment 30 unlatched by the quick hitch 16. FIG. 19B is a side view of the attachment 30 latched by the quick hitch 16.

The quick hitch 16 includes a pair of left and right brackets 50, a pair of left and right latching mechanisms 51, a latch cylinder 52, and the like. The brackets 50 hold the attachment 30. The latching mechanisms 51 are selectively operable in a latching state in which the attachment 30 is secured to the brackets 50 (quick hitch 16) or an unlatching state in which the attachment 30 is allowed to be detached from the brackets 50. The latch cylinder 52 is a latch actuator to place the latching mechanisms 51 selectively in the latching state or the unlatching state.

As illustrated in FIG. 19A, each of the brackets 50 includes a front plate 50*f* and a pair of connector plates 50*t* projecting rearward from the front plate 50*f*. The connector plates 50*t* have pivotally connected thereto the distal ends of the left and right booms 11 (FIG. 17) via shafts 61, and have pivotally connected thereto ends of the left and right front cylinders 15 (FIG. 17) via shafts 62. The connector plates 50*t* are connected to a beam 53, so that the pair of brackets 50 are combined.

The front plate 50*f* of each of the brackets 50 includes an upper portion 50*u* bent in the form of the letter V as illustrated in FIG. 19A. The front plate 50*f* includes a lower portion 50*b* bent such that the lower portion 50*b* projects diagonally rearward. A top plate 72 bent downward is provided above a base plate 71 of the attachment 30. The base plate 71 includes a lower portion 71*b* bent such that the lower portion 71*b* projects diagonally rearward. The lower portion 71*b* of the base plate 71 has a through-hole 71*h*.

The upper portions 50*u* of the front plates 50*f* of the brackets 50 are inserted into the gap between the base plate 71 and the top plate 72 of the attachment 30 and engage with the back surface of the top plate 72, the front surfaces of the front plates 50*f* engage with the base plate 71, and the lower portions 50*b* of the front plates 50*f* engage with the lower portion 71*b* of the base plate 71. With this, the attachment 30 is held by the brackets 50.

The latching mechanisms 51 are located inward of the connector plates 50*t* of the brackets 50 in FIG. 18. Each of the latching mechanisms 51 includes, as illustrated in FIG. 19A, a latch pin 54, a link 55, a coil spring 56, a latch lever 57, and the like. The latch pin 54 is held by a housing 58 fixed to a corresponding bracket 50 such that the latch pin 54 is movable up and down. The latch pin 54 includes a lower portion projecting downward from the housing 58, and the lower portion has an inclined surface sloping diagonally forward and downward. The latch pin 54 includes an upper portion rotatably connected to a lower end portion of the link 55 via pin(s). The link 55 is inserted in the coil spring 56. The link 55 includes an upper end portion projecting from the coil spring 56, and the upper end portion is held by a holder 59.

Each latch lever 57 is substantially in the form of the letter L as illustrated in FIG. 18. The latch lever 57 includes a bent intermediate portion which is rotatably connected to a mount 50*d* on a corresponding bracket 50 via pin(s) as illustrated in FIG. 19A. The latch lever 57 includes a first projecting portion 57*a* which projects inward from corresponding connector plates 50*t* as illustrated in FIG. 18. The latch lever 57 includes a second projecting portion 57*b* projecting downward. The second projecting portion 57*b* has, connected to a back surface of a central portion thereof, the holder 59 via pin(s) as illustrated in FIG. 19A. The latch lever 57 includes a third projecting portion 57*c* which projects upward as illustrated in FIG. 18.

The latch cylinder 52 is a hydraulic cylinder which is positioned laterally and located above the beam 53. The latch cylinder 52 has a first end (distal end of the rod) pivotally connected to the distal end portion of the second projecting portion 57*b* of one of the latch levers 57 (right latch lever 57 in FIG. 18) via pin(s). The latch cylinder 52 has a second end (bottom of the cylinder case) pivotally connected to the distal end portion of the second projecting portion 57*b* of the other of the latch levers 57 (the left latch lever 57 in FIG. 18) via pin(s).

The retraction of the latch cylinder 52, as indicated by dot-dot-dash lines in FIG. 18, causes the second projecting portions 57*b* of the left and right latch levers 57 to approach each other, causing the latch levers 57 to pivot upward. Then, as illustrated in FIG. 19A, the links 55 and the latch pins 54 move upward and the latch pins 54 detach from the through-holes 71*h* in the base plate 71 of the attachment 30.

With this, the latching mechanisms 51 are placed in their unlatching state (also referred to as "unlock state") in which the latching mechanisms 51 do not hold the attachment 30, allowing the attachment 30 to be detached from the quick hitch 16. The third projecting portions 57*c* of the latch levers 57 contact corresponding connector plates 50*t* of the brackets 50, so that the degree of retraction of the latch cylinder 52, the angle of upward rotation of the latch levers 57, and the degree of upward movement of the latch pins 54 are restricted.

Upon the extension of the latch cylinder 52 as indicated by solid lines in FIG. 18 from the state as illustrated in FIG. 19A, the second projecting portions 57*b* of the left and right latch levers 57 are pushed to cause the latch levers 57 to pivot downward. Upon such pivoting, the holders 59 cause the links 55 and the latch pins 54 to move downward and compress the coil springs 56. Then, as illustrated in FIG. 19B, the latch pins 54 are inserted in the through-holes 71*h* in the base plate 71 of the attachment 30, so that the inclined surfaces of the latch pins 54 contact the side walls of the through-holes 71*h*.

With this, the latching mechanisms 51 are placed in their latching state (also referred to as "lock state") in which the latching mechanisms 51 hold the attachment 30, and the attachment 30 is attached to the quick hitch 16. The second projecting portions 57*b* of the latch levers 57 contact corresponding connector plates 50*t* of the brackets 50, so that the degree of extension of the latch cylinder 52, the angle of downward rotation of the latch levers 57, and the degree of downward movement of the latch pins 54 are restricted. It is noted here that the spring back force of the coil springs 56 holds the latch levers 57 in position. Since the first projecting portions 57*a* of the latch levers 57 are positioned horizontally, the user seated on the seat 8 of the working vehicle 1 confirms that the attachment 30 is attached to the quick hitch 16 (working vehicle 1) by looking at the horizontally positioned first projecting portions 57*a*.

Starting from the state as illustrated in FIG. 17 in which the bucket 30*a* is attached to the quick hitch 16, the bucket 30*a* is detached and another attachment 30 is attached to the quick hitch 16. This makes it possible to perform work other than excavation (or some other excavation work) using the other attachment 30.

Examples of attachments 30 other than the bucket 30*a* include pallet forks, skid cutters, crushers, breakers, angle brooms, earth augers, grapple, sweepers, mowers, snow blowers, and spreaders. Attachments 30 of each type may have different specifications such as sizes and/or shapes.

FIG. 1 is a block diagram of an attachment usage system 100 and the working vehicle 1 according to the present example embodiment. The attachment usage system 100 includes the working vehicle(s) 1 and attachment(s) 30. The example in FIG. 1 includes one working vehicle 1 and two attachments 30, but the number of working vehicles 1 and the number of attachments 30 included in the attachment usage system 100 may be selected appropriately.

The working vehicle 1 includes a controller 21, one or more nonvolatile memories 22, a beacon scanner 23, a communicator 24, a user interface (indicated as "UI" in FIG. 1) 25, a battery 20, switches (each indicated as "SW" in FIGS. 1) 26 to 29, and/or the like.

The controller 21 includes, for example, an information processor circuit including CPU(s) and memory (memories). Specifically, the controller 21 includes a processor or a computer. The controller 21 is configured or programmed to control operation of elements of the working vehicle 1. The controller 21 includes an internal memory 21*a* (first memory) which is a volatile memory or a nonvolatile memory. The controller 21 may, for example, use a predetermined storage area of the internal memory 21*a* which is a volatile memory as a buffer for temporary storage of information and data.

The one or more nonvolatile memories 22 (second memory, third memory) are provided externally to the controller 21. The internal memory 21*a* and the nonvolatile memory 22 store software program(s) and control data for the controller 21 to control operation of the elements. The nonvolatile memory 22 stores pieces of control data corresponding to various attachments 30.

The beacon scanner 23 is a receiver to receive wireless signals (beacon signals) compliant with Bluetooth (registered trademark) Low Energy which is a near field communication standard. The beacon scanner 23 measures the received signal strength indicator (RSSI, received signal strength) of the received wireless signals.

The communicator 24 includes an electric circuit (communication interface) for communication via at least one of wireless LAN, near field communication, the Internet, or the like. The communicator 24 communicates with the portable device 70 in a wireless manner. The portable device 70 is a smartphone, a tablet computer, and/or the like. The user interface 25 includes an input and an output, and includes, for example, a touchscreen (touch panel) including a display and/or the like. For another example, the user interface 25 may include an input and an output (display) provided independently of each other.

The battery 20 supplies electricity to electric equipment in and/or on the working vehicle 1. The attaching switch 26, the detaching switch 27, the auxiliary mode switch 28, and the auxiliary output switch 29 are respective operation switches to be operated by the user of the working vehicle 1. The attaching switch 26 and the detaching switch 27 are momentary operation switches. The user interface 25 and the switches 26 to 29 are provided operably in the vicinity of the seat 8 in the cabin 3.

The attaching switch 26 is operated to attach the attachment 30 to the quick hitch 16. The detaching switch 27 is operated to allow the attachment 30 to be detached from the quick hitch 16. The auxiliary mode switch 28 is operated to start an auxiliary mode in which predetermined attachment(s) 30 are usable. The auxiliary output switch 29 is operated to supply (transmit) hydraulic fluid as power to the hydraulic fluid outlet port 18*a*.

The working vehicle 1 includes, as hydraulic-related features, a main pump P1, a pilot pump P2, a control valve unit (indicated as "CVU" in FIG. 1) 40, a proportional valve 41, a regulator 42, sensors 43 and 44, hydraulic actuators 14, 15, 46L, 46R, and 52, fluid passage(s), a tank, and/or the like. The main pump P1 and the pilot pump P2 are driven by power from a prime mover 9 to deliver hydraulic fluid sucked from the tank to fluid passage(s). The prime mover 9 includes, for example, an engine. For another example, the prime mover 9 may include an electric motor.

The main pump P1 is a variable displacement hydraulic pump. The regulator 42 changes the angle of the swash plate of the main pump P1. The controller 21 controls the opening of the proportional valve 41 to apply pilot pressure, which is the hydraulic pressure of hydraulic fluid delivered by the pilot pump P2, to the regulator 42. The controller 21 then actuates the regulator 42 to change the angle of the swash plate of the main pump P1 to change the amount of hydraulic fluid delivered by the main pump P1. Operating equipment 47 includes the travel operator 6 and work operator 7, operating valves corresponding to the travel operator 6 and the work operator 7, switching valve(s), and the like.

The control valve unit 40 allows hydraulic fluid supplied from the main pump P1 through fluid passage(s) to flow to the boom cylinders 14 and the front cylinders 15 of the working device 4, the latch cylinder 52 of the quick hitch 16, and the hydraulic fluid outlet port 18*a*. The control valve unit 40 also allows hydraulic fluid that flows from the boom cylinders 14, the front cylinders 15, the latch cylinder 52, and the hydraulic fluid inlet port 18*b* (return fluid) to be discharged. The control valve unit 40 controls the direction and amount of supply of hydraulic fluid to the boom cylinders 14, the front cylinders 15, and the latch cylinder 52. The control valve unit 40 also controls the amount of supply of hydraulic fluid to the hydraulic fluid outlet port 18*a*.

Specifically, the control valve unit 40 includes control valves 40*a*, 40*b*, 40*c*, and 40*d* corresponding to the boom cylinders 14, the front cylinders 15, the latch cylinder 52, and the ports 18*a* and 18*b*. Each of the control valves 40*a*, 40*b*, 40*c*, and 40*d* is switchable between a neutral position, a first position, and a second position. At least the control valves 40*c* and 40*d*, corresponding to the latch cylinder 52 and the ports 18*a*, 18*b*, of the control valves 40*a*, 40*b*, 40*c*, and 40*d* are electrically actuated solenoid valves. The control valves 40*a*, 40*b*, 40*c*, and 40*d* are normally held in the neutral position by the elastic force of a spring.

The operating equipment 47 includes the work operator 7 and work operating valves corresponding to the work operator 7. The work operating valve(s) is/are actuated according to the manner in which the work operator 7 is operated, thus allowing the pilot pressure of pilot fluid from the pilot pump P2 to act on pressure receiver(s) of the corresponding control valve(s) 40*a* and/or 40*b* via the actuated work operating valve(s). For example, the work operator 7 may be supported on the work operating valves and the work operating valves may be physically actuated by operation of the work operator 7. Additionally or alternatively, a detection sensor to detect the amount (degree) and direction of operation of the work operator 7 may be provided and the controller 21 may electrically actuate the work operating valve(s) based on the detection result from the detection sensor.

With this, the control valve(s) 40*a* and/or 40*b* is/are switched from the neutral position to the first position or the second position, so that hydraulic fluid from the main pump P1 is supplied through the control valve(s) 40*a* and/or 40*b* to the boom cylinders 14 and/or the front cylinders 15 to cause the boom cylinders 14 and/or the front cylinders 15 to extend or retract. It follows that the booms 11 and/or the attachment 30 such as the bucket 30*a* attached to the quick hitch 16 swing.

The pilot pressure (work operating pressure) acting on the pressure receivers of the control valves 40*a* and 40*b* from the work operating valves of the operating equipment 47 is detected by pressure sensors 49*a*. Although only a single pressure sensor 49*a* is illustrated in FIG. 1, actually pressure sensors 49*a* (four pressure sensors 49*a*) are connected to respective fluid passages (four fluid passages) to supply pilot fluid to respective pressure receivers of the control valves 40*a* and 40*b* (two pressure receivers of the control valve 40*a* and two pressure receivers of the control valve 40*b*). The controller 21 determines the operation state of the work operating valves and the work operator 7 of the operating equipment 47 based on the pilot pressure detected by the pressure sensors 49*a*.

For another example, detection sensor(s) such as potentiometer(s) to detect the angle of rotation of the work operator 7, etc. may be provided instead of the pressure sensors 49*a*. The controller 21 may determine the operation state of the work operating valves and the work operator 7 of the operating equipment 47 based on output signal(s) from the detection sensor(s). Such detection sensors and pressure sensors 49*a* are examples of work operation sensors to detect the operation state of the work operator 7, and the work operation sensors are not limited to those described above. In a case that the work operator 7 is an electric work operator to output an electric signal (operation signal) corresponding to the operation state such as a joystick, the controller 21 may determine the operation state of the work operator based on the electric signal.

The pressure of hydraulic fluid supplied from the control valves 40*a* and 40*b* to the boom cylinders 14 and the front cylinders 15, i.e., the supply pressure of hydraulic fluid to the boom cylinders 14 and the supply pressure of hydraulic fluid to the front cylinders 15, are detected by pressure sensors 49*b*. Although only a single pressure sensor 49*b* is illustrated in FIG. 1, actually pressure sensors 49*b* (two pressure sensors 49*b*) are connected to a fluid passage to supply hydraulic fluid from the control valve 40*a* to the boom cylinders 14 and a fluid passage to supply hydraulic fluid from the control valve 40*b* to the front cylinders 15.

The controller 21 determines the action status (acting state or stopped state) of the working device 4 (including the boom cylinders 14, booms 11, front cylinders 15, quick hitch 16, and the like) based on the supply pressure of hydraulic fluid to the boom cylinders 14 and the supply pressure of hydraulic fluid to the front cylinders 15 detected by the pressure sensors 49*b*. The controller 21 regards the supply pressure of hydraulic fluid to the boom cylinders 14 and the supply pressure of hydraulic fluid to the front cylinders 15 as loads on the boom cylinders 14 and the front cylinders 15, and regards the greater of the supply pressures as the load on the working device 4.

For another example, detection sensor(s) to detect the angle of rotation achieved by the boom cylinders 14 and the front cylinders 15, and vibration, acceleration, and/or the like of the boom cylinders 14 and the front cylinders 15 may be provided instead of the pressure sensors 49*b*. Such detection sensors and pressure sensors 49*b* are examples of work detection sensors to detect the action status of the boom cylinders 14 and the front cylinders 15, and the work detection sensors are not limited to those described above. In a case that the control valves 40*a* and 40*b* are solenoid valves, the controller 21 may determine the action status of the working device 4 based on the switching positions of the control valves 40*a* and 40*b* controlled by the controller 21.

Of the switches 26 to 29 connected to the controller, while the attaching switch 26 is being operated, the controller 21 places the control valve 40*c* in the first position to allow hydraulic fluid from the main pump P1 to be supplied to the latch cylinder 52 in the first direction to cause the latch cylinder 52 to extend. Accordingly, the operation of the attaching switch 26 that lasts for a predetermined period of time or more while the latching mechanisms 51 are in the unlatching state causes the latch cylinder 52 to extend to the predetermined degree or more, bringing the latching mechanisms 51 into the latching state.

Even if the attaching switch 26 is operated, provided that the operation only lasts for a period less than the predetermined period of time, the latch cylinder 52 does not extend to the predetermined degree or more and therefore the latching mechanisms 51 are not brought into the latching state. Therefore, the latching mechanisms 51 are moved back by the spring back force of the coil springs 56 to the original unlatching state.

On the contrary, while the detaching switch 27 is being operated, the controller 21 places the control valve 40*c* in the second position to allow hydraulic fluid from the main pump P1 to be supplied to the latch cylinder 52 in a second direction opposite to the first direction to cause the latch cylinder 52 to retract. Accordingly, the operation of the detaching switch 27 that lasts for a predetermined period of time or more while the latching mechanisms 51 are in the latching state causes the latch cylinder 52 to retract to a predetermined degree or more, bringing the latching mechanisms 51 into the unlatching state.

Even if the detaching switch 27 is operated, provided that the operation only lasts for a period less than the predetermined period of time, the latch cylinder 52 does not retract to the predetermined degree or more and therefore the latching mechanisms 51 are not brought into the unlatching state. Therefore, the latching mechanisms 51 are moved back by the spring back force of the coil springs 56 to the original latching state. The controller 21 determines whether the latching mechanisms 51 are in the latching state or the unlatching state based on, for example, the position of the control valve 40*c*.

The predetermined periods of time for the switches 26 and 27 are each, for example, about 2 to 3 seconds. The predetermined periods of time for the switches 26 and 27 may be the same period or different periods. The specific values of the predetermined periods of time are examples, and not limited to the values above. The specific values of another predetermined period of time and a period of time (described later) are also examples and not limited thereto.

When the auxiliary mode switch 28 is operated and the auxiliary mode is selected, a specific attachment 30 is attached to the quick hitch 16. The hydraulic fluid outlet port 18*a* and a hydraulic fluid inlet port 38*b* of the specific attachment 30*b* are connected together by a hose, and the hydraulic fluid inlet port 18*b* and a hydraulic fluid outlet port 38*a* of the specific attachment 30*b* are connected together by a hose.

Upon operation of the auxiliary output switch 29 under such circumstances, the controller 21 switches the control valve 40*d* from the neutral position to the first position or the second position. With this, hydraulic fluid from the main pump P1 is supplied (transmitted) through a fluid passage 45*a* to the hydraulic fluid outlet port 18*a*, and hydraulic fluid flowing into a fluid passage 45*b* from the hydraulic fluid inlet port 18*b* is drained through the control valve unit 40.

The hydraulic fluid discharged through the hydraulic fluid outlet port 18*a* is introduced into the specific attachment 30*b* through the hydraulic fluid inlet port 38*b* via a hose or the like. Furthermore, hydraulic fluid (return fluid) discharged through the hydraulic fluid outlet port 38*a* of the specific attachment 30*b* is introduced through the hydraulic fluid inlet port 18*b* via a hose or the like and is drained from the control valve unit 40. Since hydraulic fluid is introduced and discharged to and from the specific attachment 30*b* as such, hydraulic actuators 36 such as a hydraulic motor and/or hydraulic cylinder(s) of the attachment 30*b* are actuated, making it possible to perform work using the attachment 30*b*.

When allowing hydraulic fluid to be introduced and discharged to and from the specific attachment 30*b*, the controller 21 changes the opening of the control valve 40*d* depending on what specific attachment 30*b* is attached to the quick hitch 16, to adjust the flow rate or hydraulic pressure of hydraulic fluid supplied to the hydraulic fluid outlet port 18*a*. For example, the controller 21 may cause the flow rate sensor 43 to detect the flow rate of hydraulic fluid flowing through the fluid passage 45*a* and control the opening of the control valve 40*d*. Additionally or alternatively, the controller 21 may cause the pressure sensor 44 to detect the hydraulic pressure of hydraulic pressure flowing through the fluid passage 45*a* and control the opening of the control valve 40*d*.

The pair of left and right traveling devices 5 include a pair of left and right hydro-static transmissions (HSTs) 46L and 46R corresponding to the pair of left and right traveling devices 5. Each of the HSTs 46L and 46R includes hydraulic pump(s) and a travel motor (hydraulic motor).

The operating equipment 47 includes the travel operator 6 and travel operating valves corresponding to the travel operator 6. The travel operating valve(s) is/are actuated according to the manner in which the travel operator 6 is operated, thus allowing the pilot pressure of pilot fluid from the pilot pump P2 to act on pressure receiver(s) of the hydraulic pump(s) of the corresponding HST(s) 46L and/or 46R via the actuated travel operating valve(s) and changing the angle of inclination of swash plate(s) of the hydraulic pump(s). For example, the travel operator 6 may be supported on the travel operating valves and the travel operating valves may be physically actuated by operation of the travel operator 6. Additionally or alternatively, a detection sensor to detect the amount (degree) and direction of operation of the travel operator 6 may be provided and the controller 21 may electrically actuate the travel operating valve(s) based on the detection result from the detection sensor.

This controls the supply, the stopping of supply, and the direction of supply of hydraulic fluid from the hydraulic pump(s) of the HSTs 46L and/or 46R to the travel motor(s), the travel motor(s) rotate(s) in the forward direction, rotate in the reverse direction, or stop, the left and/or right traveling device(s) 5 also rotate(s) in the forward direction, rotate in the reverse direction, or stop, and the working vehicle 1 travels forward, rearward, turn left or right, or stops.

The operating equipment 47 includes a travel switching valve for speed change. The position of the travel switching valve is switched in response to a control signal from the controller 21, thus changing the angle of inclination of the swash plate(s) of the travel motor(s) of the HSTs 46L and/or 46R. With this, the rotation speed of the travel motor(s) increases or decreases, so that the travel speed of the traveling devices 5 and the working vehicle 1 is changed.

The pilot pressure (travel operating pressure) acting on the pressure receivers of the hydraulic pumps of the HSTs 46L and 46R from the travel operating valves of the operating equipment 47 is detected by pressure sensors 48*a*. Although only a single pressure sensor 48*a* is illustrated in FIG. 1, actually pressure sensors 48*a* (four pressure sensors 48*a*) are connected to respective fluid passages (four fluid passages) to supply pilot fluid to respective pressure receivers of the hydraulic pumps of the HSTs 46L and 46R (two pressure receivers of the hydraulic pump of the HST 46L and two pressure receivers of the hydraulic pump of the HST 46R). The controller 21 determines the operation state of the travel operating valves and the travel operator 6 of the operating equipment 47 based on the pilot pressure detected by the pressure sensors 48*a*.

For another example, detection sensor(s) such as potentiometer(s) to detect the angle of rotation of the travel operator 6, etc. may be provided instead of the pressure sensors 48*a*. The controller 21 may determine the operation state of the travel operating valves and the travel operator 6 of the operating equipment 47 based on output signal(s) from the detection sensor(s). Such detection sensors and pressure sensors 48*a* are examples of travel operation sensors to detect the operation state of the travel operator 6, and the travel operation sensors are not limited to those described above. In a case that the travel operator 6 is an electric travel operator, such as a joystick, to output an electric signal (operation signal) corresponding to the operation state, the controller 21 may determine the operation state of the travel operator based on the electric signal.

The pressure of hydraulic fluid supplied from the hydraulic pumps of the HSTs 46L and 46R to the travel motors, i.e., the travel pressure for the left traveling device 5 and the travel pressure for the right traveling device 5, are detected by pressure sensors 48*b*. Although only a single pressure sensor 48*b* is illustrated in FIG. 1, actually pressure sensors 48*b* (four pressure sensors 48*b*) are connected to fluid passages (supply fluid passage and return fluid passage) to allow hydraulic fluid to circulate between the hydraulic pump of the HST 46L and the travel motor corresponding to the left traveling device 5 and fluid passages (supply fluid passage and return fluid passage) to allow hydraulic fluid to circulate between the hydraulic pump of the HST 46R and the travel motor corresponding to the right traveling device 5.

The controller 21 determines the action status (traveling forward/rearward, turning, and stopping) of the traveling devices 5 (left traveling device 5 and right traveling device 5) based on the travel pressure detected by the pressure sensors 48*b*. The controller 21 may cause rotation speed sensors 48*c* to detect the rotation speed of the travel motors of the HSTs 46L and 46R instead of the pressure sensors 48*b*, and determine the action status of the traveling devices 5 based on the detection result. The rotation speed sensors 48*c* and the pressure sensors 48*b* are examples of travel detection sensors to detect the action status of the traveling devices 5, and the travel detection sensors are not limited to those described above.

The attachment 30 attachable to the working vehicle 1 is provided with a beacon transmitter 33. The beacon transmitter 33 is a transmitter to periodically transmit an advertisement signal (also called "advertisement packet" or "beacon signal") which is a wireless signal compliant with Bluetooth (registered trademark) Low Energy. The beacon transmitter 33 looks like a small tag, and is therefore sometimes called a "BLE tag". The beacon transmitter 33 includes a microcomputer, a memory, a transmitter circuit, a battery, a vibration sensor 34, and/or the like. The elements of the beacon transmitter 33 are driven by electricity from the battery. The beacon transmitter 33 transmits the advertisement signal at interval(s) of, for example, about 1 second to about 3 seconds, but the intervals are not limited to about 1 second to about 3 seconds and may be selected as appropriate.

Figure 2:
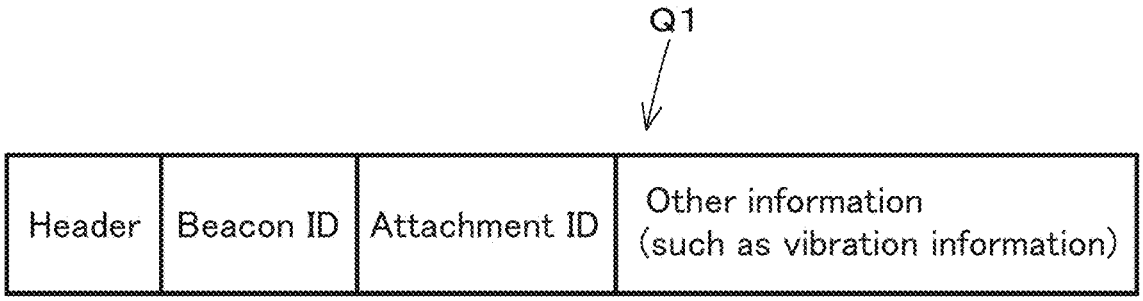
FIG. 2 is a diagram showing an example of information included in an advertisement signal.

FIG. 2 shows an example of information contained in an advertisement signal Q1 transmitted from the beacon transmitter 33. The advertisement signal Q1 includes a header, a beacon ID, an attachment ID, and other information. The beacon ID is identification information relating to the beacon transmitter 33 which is the sender of the advertisement signal Q1. The attachment ID is identification information relating to the attachment 30 in or on which the beacon transmitter 33 which is the sender of the advertisement signal Q1 is provided.

The other information in the advertisement signal Q1 includes vibration information relating to the vibration state detected by the vibration sensor 34 of the beacon transmitter 33 which is the sender, i.e., vibration information relating to the vibration state of the attachment 30 in or on which the beacon transmitter 33 is provided. The vibration information may include information such as a message indicating whether or not the attachment 30 is vibrating (presence or absence of vibration). The vibration information may include, instead of or in addition to the information such as a message, a vibration indicator (numerical value) indicating the magnitude of vibration detected by the vibration sensor 34. The vibration indicator may be, for example, at least one of the displacement, velocity, or acceleration of vibrations of the attachment 30 detected by the vibration sensor 34.

Inertial sensor(s) such as an acceleration sensor and/or a gyroscope sensor may be used as the vibration sensor 34.

As illustrated in FIG. 17, the beacon transmitter 33 is located on, for example, the back surface of the attachment 30 that faces the vehicle body 2 of the working vehicle 1. The beacon scanner 23 is located at, for example, the front portion of the vehicle body 2 that faces the attachment 30. The controller 21 is provided in the vehicle body 2. Since the beacon scanner 23 is provided in or on the vehicle body 2, it is possible to achieve a configuration in which output signals from the beacon scanner 23 can be inputted into the controller 21 using simple electric wiring or simple communication circuit(s) as compared to cases where the beacon scanner 23 is provided on the movable working device 4.

The advertisement signal Q1 transmitted from the beacon transmitter 33 is received by the beacon scanner 23 of the working vehicle 1. The controller 21 identifies (recognizes) the attachment 30 provided with the beacon transmitter 33 (sender) based on the attachment ID included in the advertisement signal Q1 received by the beacon scanner 23.

In the case where one or more attachments 30 are present in the vicinity of the working vehicle 1, one or more advertisement signals Q1 from one or more beacon transmitters 33 of the one or more attachments 30 are received by the beacon scanner 23. Upon receipt of each advertisement signal Q1, the beacon scanner 23 measures the RSSI of the advertisement signal Q1.

The controller 21 causes the internal memory (first memory) 21*a* to store, in its predetermined storage area, information included in the advertisement signal Q1 received by the beacon scanner 23 (FIG. 2), thus collecting such information. In so doing, the controller 21 generates advertisement (ADV) information including information included in the advertisement signal Q1 and time information indicating the receipt time point (date and time) at which the advertisement signal Q1 was received, and causes the internal memory 21*a* to store the ADV information in its predetermined storage area. The controller 21 may also include the value indicating the RSSI of the advertisement signal Q1 into the ADV information.

FIG. 3 illustrates ADV information stored (collected) in the predetermined storage area of the internal memory 21*a*. In order to keep the capacity of the predetermined storage area of the internal memory 21*a* at a certain level, the controller 21 may delete the ADV information (or overwrite the ADV information with newly generated ADV information) after storing it in the internal memory 21*a* for a period of time.

In the case of attaching an attachment 30 on the ground, etc. to the working vehicle 1, while no attachments 30 are attached to the quick hitch 16, i.e., while the latching mechanisms 51 are in the unlatching state, the user of the working vehicle 1 operates the travel operator 6 to cause the traveling devices 5 to travel forward to cause the working device 4 to approach the rear portion of the attachment 30. The user operates the work operator 7 along the first direction to actuate the boom cylinders 14 to raise or lower the booms 11 of the working device 4 so that the height of the quick hitch 16 at the distal end of the booms 11 matches the height of the attachment 30. The user operates the work operator 7 along the second direction to actuate the front cylinders 15 so that the angle (tilt) of the front plates 50*f* of the brackets 50 of the quick hitch 16 matches the angle of the base plate 71 of the attachment 30.

Next, the user operates the travel operator 6 to cause the traveling devices 5 to travel forward to some degree at very low speed to cause the front plates 50*f* of the quick hitch 16 to engage with the base plate 71 of the attachment 30 as illustrated in FIG. 19A, thus causing the brackets 50 to hold the attachment 30. In so doing, the user may, after causing the front plates 50*f* to engage with the base plate 71, use the work operator 7 to raise the booms 11 to some degree or cause the quick hitch 16 to swing upward to some degree to cause the working device 4 to lift up the attachment 30 to some degree to check whether the attachment 30 is held by the brackets 50.

As such, the attachment 30 vibrates, for example, when the front plates 50*f* of the brackets 50 engage with the base plate 71, when the attachment 30 is lifted up by the working device 4, and when the attachment 30 is latched by the latching mechanisms 51. The advertisement signal Q1 transmitted from the beacon transmitter 33 in or on the attachment 30 includes vibration information relating to the vibration state of the attachment 30 detected by the vibration sensor 34 when such an instance occurs.

When (i) the latching mechanisms 51 are in the unlatching state and (ii) at least one of the traveling devices 5 or the working device 4 is performing an action to attach an attachment 30, i.e., when an attachment 30 is about to be attached to the working vehicle 1, the beacon scanner 23 receives one or more advertisement signals Q1 periodically transmitted from one or more beacon transmitters 33 in or on one or more attachments 30.

Next, the controller 21 selects one or more advertisement signals Q1 which satisfy a first condition from the one or more advertisement signals Q1 received by the beacon scanner 23. The controller 21 provisionally selects one or more of the one or more attachment IDs that are included in the selected one or more advertisement signals Q1, as the piece(s) of identification information relating to the attachment(s) 30 which may possibly be attached. Note that the piece of identification information relating to an attachment 30 may be a piece of information specific to the attachment 30 such as, for example, the model number and/or serial number, etc. of the attachment 30. The first condition and the provisional selection of attachment IDs will be detailed later.

The controller 21 causes the nonvolatile memory (second memory) 22 to store, in its predetermined storage area, provisional selection information including the provisionally selected attachment ID(s), thus collecting the provisional selection information. In so doing, the controller 21 includes, into the provisional selection information, time information indicating the receipt time point(s) at which the advertisement signal(s) Q1 including the provisionally selected attachment ID(s) was/were received. The controller 21 may include the value(s) indicating the RSSI(s) of the advertisement signal(s) Q1 into the provisional selection information. FIG. 4 illustrates provisional selection information stored in the predetermined storage area of the nonvolatile memory 22.

After that, once the latching mechanisms 51 have entered the latching state, i.e., once the attachment 30 held by the quick hitch 16 has been attached (secured), the controller 21 definitively selects an attachment ID which satisfies a second condition from the provisionally selected attachment ID(s). The second condition and the definitive selection of the attachment ID will be detailed later.

After definitively selecting an attachment ID, the controller 21 starts a predetermined process based on the attachment ID. An example of the predetermined process is a process in which the controller 21 causes the user interface 25 to output (display) information indicating that the attachment 30 corresponding to the definitively selected attachment ID is attached to the quick hitch 16 (working vehicle 1). Another example of the predetermined process is a process in which the controller 21 controls output of hydraulic fluid (power) to the attachment 30 attached to the quick hitch 16 (controls start and stop of the supply of hydraulic fluid to the attachment 30) according to the definitively selected attachment ID. It is noted here that the controller 21 may also control at least one of the introduction of hydraulic fluid from the attachment 30, the amount of hydraulic fluid supplied to the attachment 30, or the pressure of hydraulic fluid supplied to the attachment 30.

Display data and control data are pre-set for each of the attachment IDs of attachments 30 attachable to the quick hitch 16, i.e., attachments 30 which can be used with the working vehicle 1.

FIG. 5 is a table showing an example of the relationship between the attachment IDs of the attachments 30 attachable to the quick hitch 16 and pieces of display data corresponding to the attachments 30. A piece of display data is data based on which the user interface 25 displays information about a corresponding attachment 30. The display data includes, for example, an icon, name, and specifications of the corresponding attachment 30. Such an attachment ID and display data of the attachment 30 are stored in a predetermined storage area of the nonvolatile memory 22 such that the attachment ID and the display data of the attachment 30 are associated with each other. Note that display data other than that described above may be stored in the nonvolatile memory 22 such that the display data is associated with the attachment ID.

FIG. 6 is a table showing an example of the relationship between the attachment IDs of the attachments 30 attachable to the quick hitch 16 and pieces of control data corresponding to the attachments 30. A piece of control data indicates control performed by the working vehicle 1 according to what attachment 30 is used. The control data includes, for example, the level of the amount of hydraulic fluid supplied to the corresponding attachment 30. Such an attachment ID and control data of the attachment 30 are stored in a predetermined storage area of the nonvolatile memory 22 such that the attachment ID and the control data of the attachment 30 are associated with each other. Note that other control data, such as the level of hydraulic pressure outputted to the attachment 30 and/or the output value of power other than hydraulic fluid, may be stored in the nonvolatile memory 22 such that the control data is associated with the attachment ID.

Figure 7:
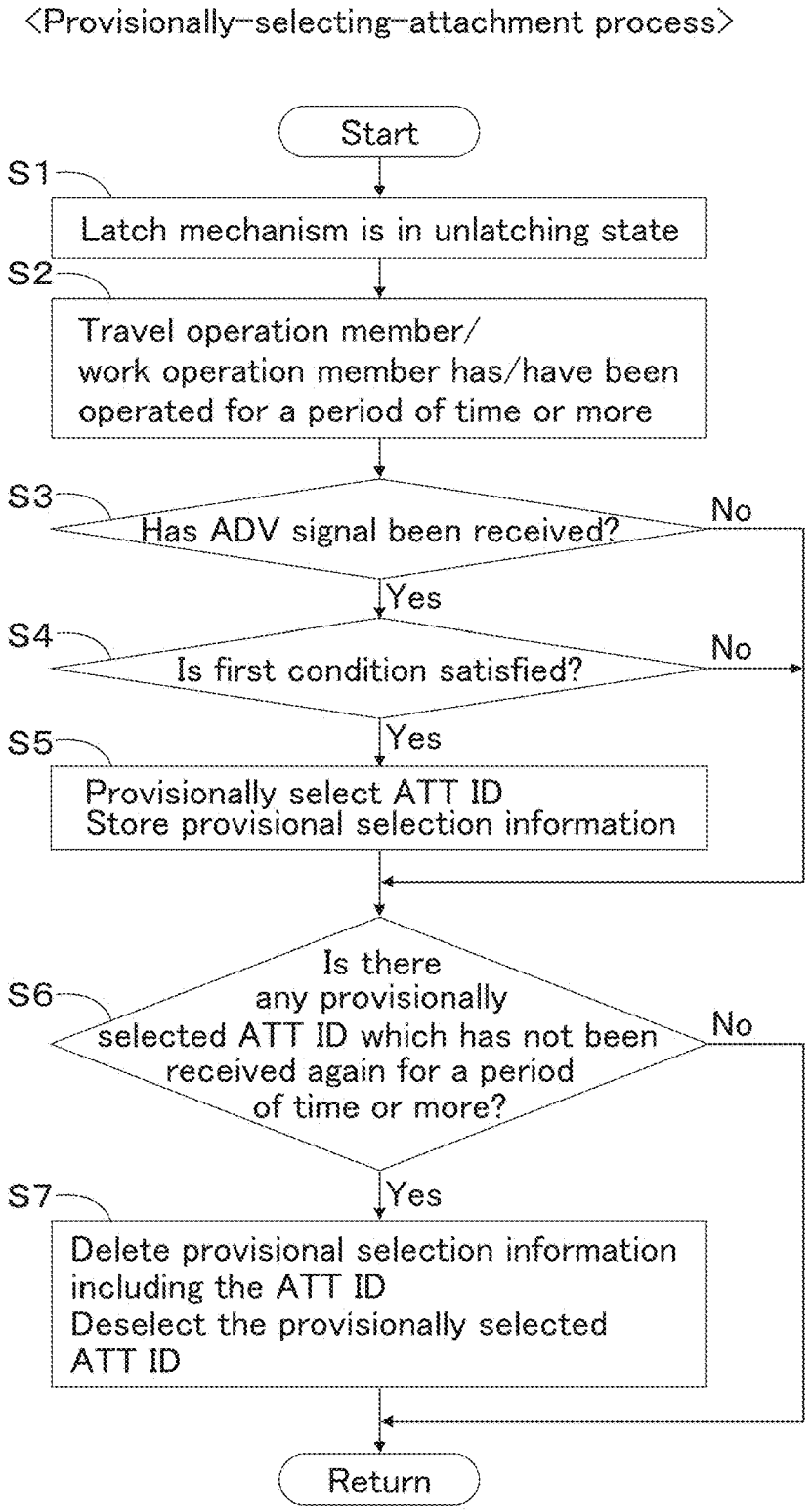
FIG. 7 is a flowchart showing an example of a provisionally-selecting-attachment process.

FIG. 7 is a flowchart showing an example of a provisionally-selecting-attachment process. The provisionally-selecting-attachment process is performed by the controller 21 of the working vehicle 1 based on software program(s) stored in the internal memory 21*a* and/or the nonvolatile memory 22. The same applies to a definitively-selecting-attachment process described later. In FIG. 7, the advertisement signal Q1 is referred to as "ADV signal" and the attachment is referred to as "ATT" for convenience of description. The same applies to FIGS. 8 to 11 and FIGS. 14 to 15B (described later).

The controller 21, upon detecting that the latching mechanisms 51 are in the unlatching state (S1) and detecting that at least one of the travel operator 6 or the work operator 7 has been operated continuously for a period of time or more (S2), determines whether any advertisement signal Q1 has been received. Once the beacon scanner 23 has received an advertisement signal Q1 from a beacon transmitter 33 (YES in S3), the controller 21 determines whether or not the received advertisement signal Q1 satisfies the first condition.

The first condition may be condition(s) relating to at least one of the RSSI of the advertisement signal Q1 or information included in the advertisement signal Q1. For example, the first condition may be (i) a condition in which the RSSI of the advertisement signal Q1 is equal to or higher than a predetermined value and/or (ii) a condition in which vibration information indicating that the attachment 30 is vibrating is included in the advertisement signal Q1.

Alternatively, the first condition may be condition(s) relating to the number of times at least one of the beacon ID included in the advertisement signal Q1 or the attachment ID included in the advertisement signal Q1 has been received. For example, the first condition may be (i) a condition in which the number of times the attachment ID included in the advertisement signal Q1 has been received is equal to or greater than a predetermined number and/or (ii) a condition in which the number of times the attachment ID has been received consecutively is equal to or greater than a predetermined number. The first condition may be a combination of the above conditions. The conditions described above are examples, and the first condition may be some other condition(s).

If the advertisement signal Q1 received by the beacon scanner 23 satisfies the first condition (YES in S4), the controller 21 provisionally selects the attachment ID included in the advertisement signal Q1, generates provisional selection information including the attachment ID, and causes the nonvolatile memory 22 to store the provisional selection information (S5, see FIG. 4).

The controller 21 reads the time information and the attachment ID included in each piece of provisional selection information stored in the nonvolatile memory 22 and determines whether any of the provisionally selected attachment ID(s) has not been received again for a predetermined period of time (for example, about 30 seconds) or more.

In so doing, the controller 21, if any of the attachment IDs included in the respective pieces of provisional selection information is different from the other attachment ID(s), checks the receipt time point indicated by the time information corresponding to such a different attachment ID, and, if the elapsed time from the receipt time point to the current time point is equal to or greater than a predetermined period of time, determines that there is a provisionally selected attachment ID which has not been received again for the predetermined period of time or more (YES in S6). Alternatively or additionally, the controller 21, if any of the attachment IDs included in the respective pieces of provisional selection information are the same as each other, checks the receipt time point indicated by the time information corresponding to the most recently received one of the same attachment IDs, and if the elapsed time from the receipt time point to the current time point is equal to or greater than a predetermined period of time, determines that there is a provisionally selected attachment ID which has not been received again for the predetermined period of time or more (YES in S6).

If the controller 21 determines that there is a provisionally selected attachment ID which has not been received again for the predetermined period of time or more as described above (YES in S6), the controller 21 deletes the piece of provisional selection information that includes the attachment ID to deselect the provisionally selected attachment ID (S7). After that, the controller 21 repeats step S1 and subsequent steps.

If no advertisement signals Q1 are received (NO in S3) or the received advertisement signal Q1 does not satisfy the first condition (NO in S4) after step S2, the controller 21 does not provisionally select any attachment ID and performs step S6 as described above.

Figure 8:
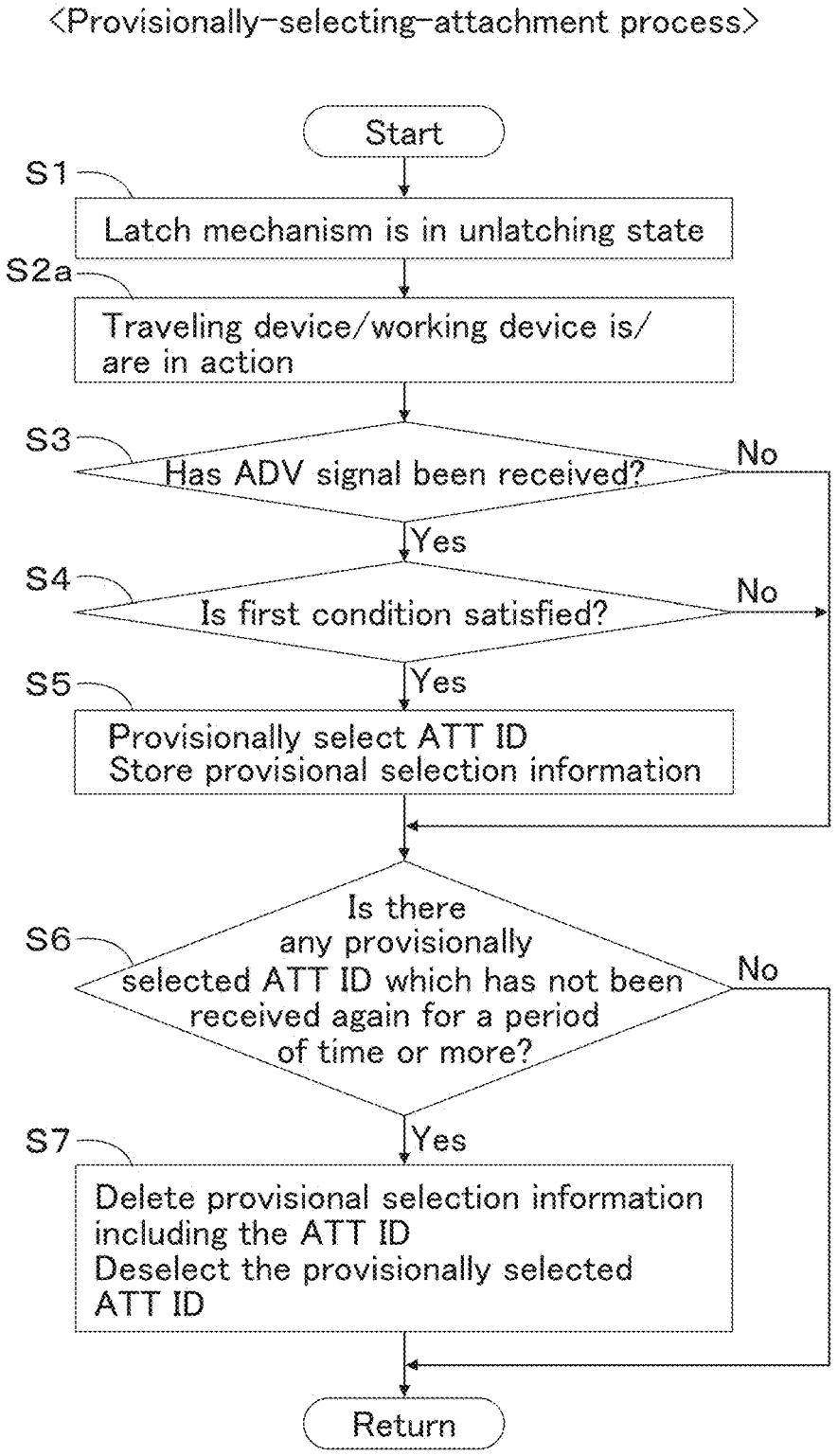
FIG. 8 is a flowchart showing another example of the provisionally-selecting-attachment process.

In the example in FIG. 7, the controller 21 determines whether any advertisement signal Q1 has been received, when at least one of the travel operator 6 or the work operator 7 had or has been operated for a period of time or more (S2). However, as shown in FIG. 8, the controller 21 may determine whether any advertisement signal Q1 has been received after detecting that at least one of the traveling devices 5 or the working device 4 is in action (S2*a*).

Figure 9:
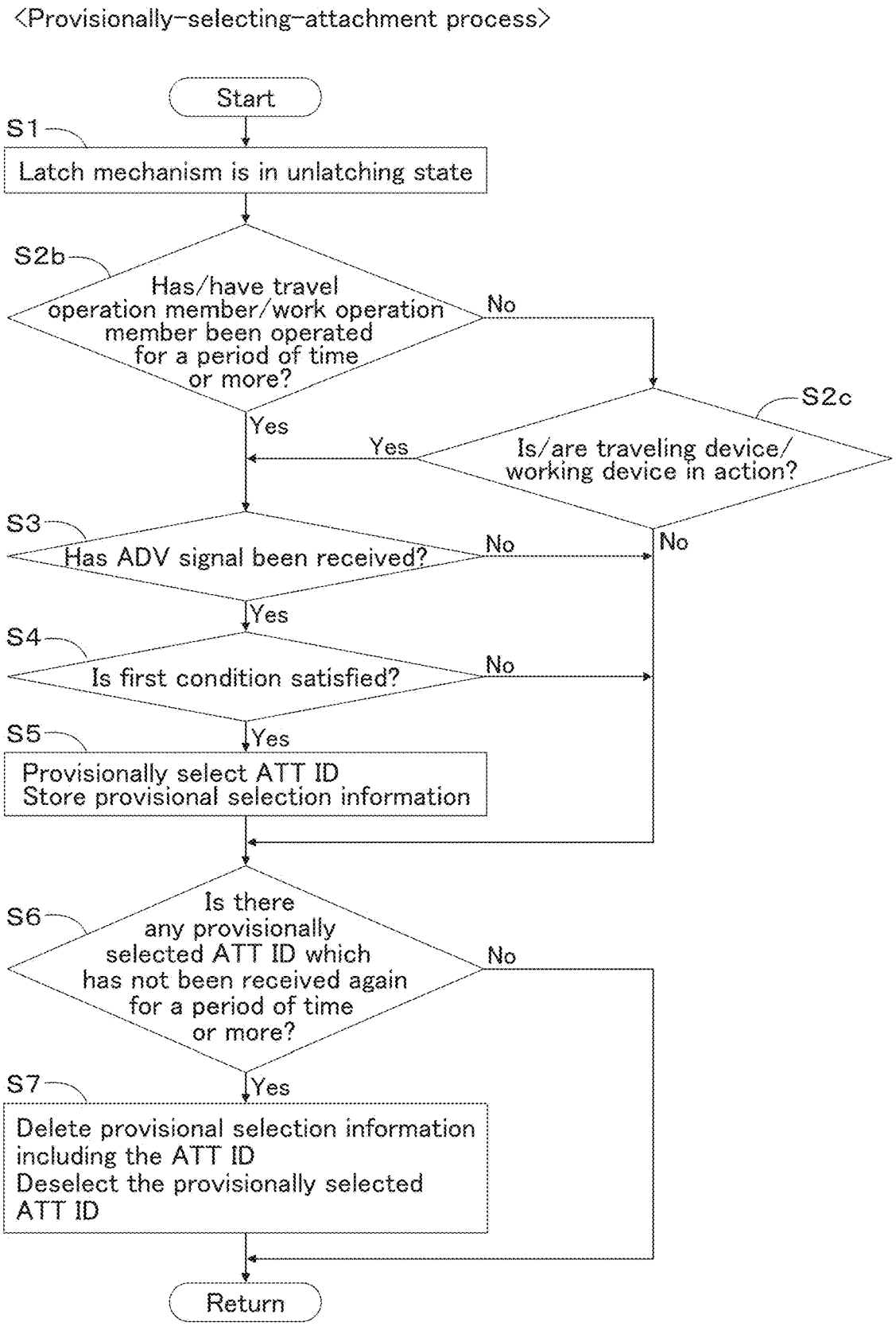
FIG. 9 is a flowchart showing a further example of the provisionally-selecting-attachment process.

Alternatively, as shown in FIG. 9, the controller 21 may determine whether any advertisement signal Q1 has been received, not only when at least one of the travel operator 6 or the work operator 7 has been operated continuously for a period of time or more (YES in S2*b*) but also when at least one of the traveling devices 5 or the working device 4 is in action (YES in S2*c*) even if neither the travel operator 6 nor the work operator 7 has been operated continuously for a period of time or more (NO in S2*b*). In the example in FIG. 9, the controller 21 performs step S6 as described above if neither the travel operator 6 nor the work operator 7 has been operated continuously for a period of time or more (NO in S2*b*) and neither the traveling devices 5 nor the working device 4 is in action (NO in S2*c*).

Figure 10:
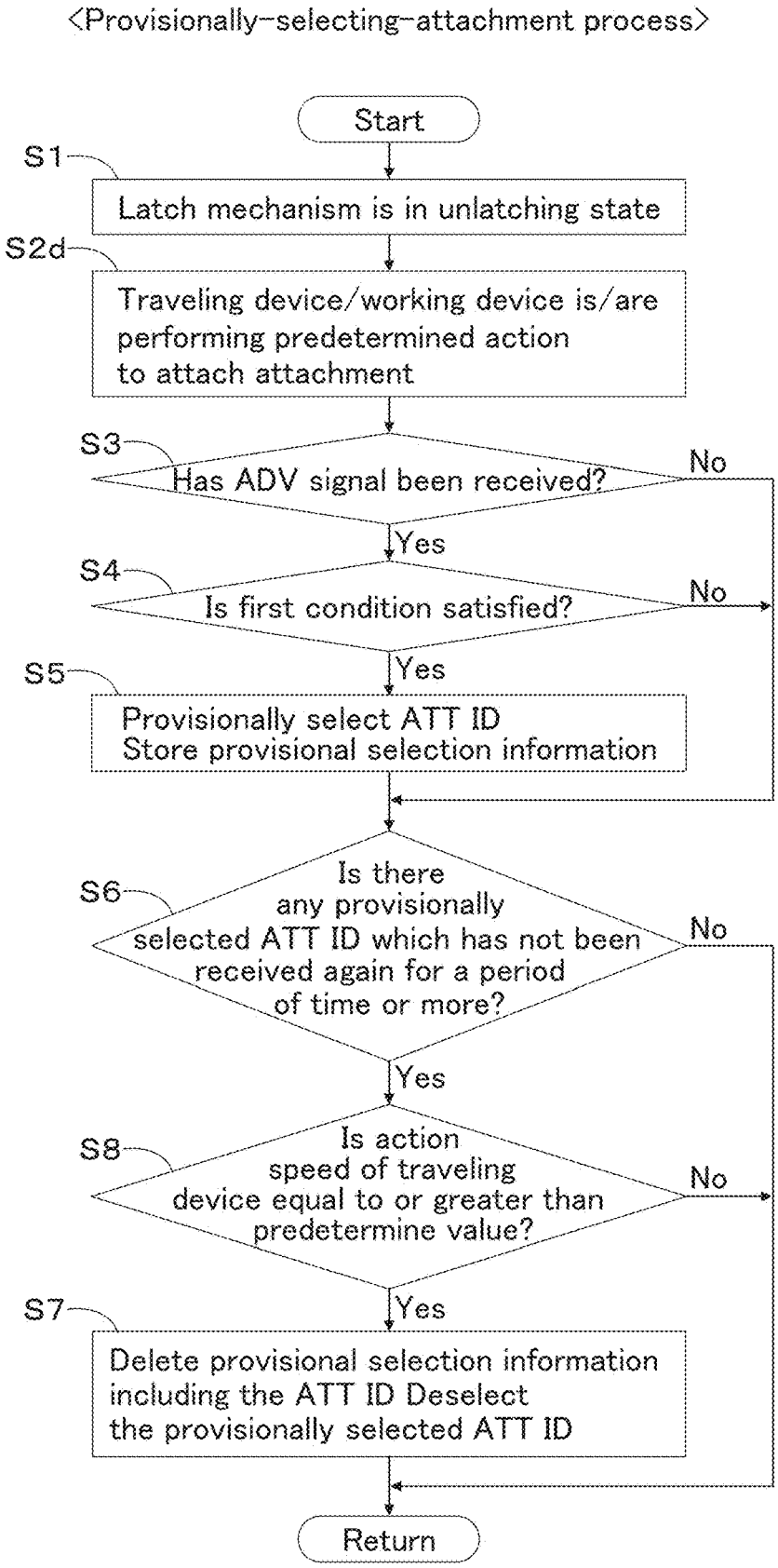
FIG. 10 is as flowchart showing a still further example of the provisionally-selecting-attachment process.

Alternatively, as shown in FIG. 10, the controller 21 may determine whether any advertisement signal Q1 has been received after detecting that at least one of the traveling devices 5 or the working device 4 is performing a predetermined action to attach the attachment 30 to the quick hitch 16 (S2*d*). The predetermined action in such a case may be, for example, an action such that (i) the booms of the working device 4 have been lowered to a predetermined position at which the height of the quick hitch 16 matches the height of the attachment 30, (ii) the travel motors are rotating forward at a rotation speed of a predetermined value or less and the traveling devices 5 are traveling forward, (iii) the quick hitch 16 is inclined at a predetermined angle that allows the quick hitch 16 to engage with the attachment 30, and/or the like. The controller 21 determines whether such action(s) is/are being performed based on the operation state of the travel operator 6, the operation state of the work operator 7, and output signals from the sensors.

In the examples in FIGS. 7 to 10, the controller 21 performs step S2, S2*a*, S2*b*, or S2*d* after step S1. Note, however, that step S1 may be performed after step S2, S2*a*, S2*b*, or S2*d*, and step S1 may be performed at the same time as any step S2, S2*a*, S2*b*, or S2*d*.

As shown in FIG. 10, the controller 21 may be configured or programmed to, if there is a provisionally selected attachment ID which has not been received again for a predetermined period of time or more (YES in S6), delete the piece of provisional selection information that includes the attachment ID to deselect the provisionally selected attachment ID (S7) if the action speed of the traveling devices 5 is equal to or greater than a predetermined value (YES in S8). Note that the controller 21 uses the rotation speed of the travel motors of the HSTs 46L and 46R detected by the rotation speed sensors 48*c* as the action speed of the traveling devices 5.

For another example, the controller 21 may be configured or programmed to perform step S3 and subsequent steps upon detecting that the attachment 30 attached to the quick hitch 16 is about to take action or is in action, instead of step S2 in FIG. 7, etc. The controller 21 detects that the attachment 30 is in action or in the stopped state based on at least one of the operation state of the auxiliary output switch 29 (FIG. 1), the position of the control valve 40*d*, or output signals from the sensors 43 and 44. As described earlier, the controller 21 may be configured or programmed to regard the acting state and the stopped state of at least one of the traveling devices 5, the working device 4, or the attachment 30 as the acting state and the stopped state of the working vehicle 1.

Figure 11:
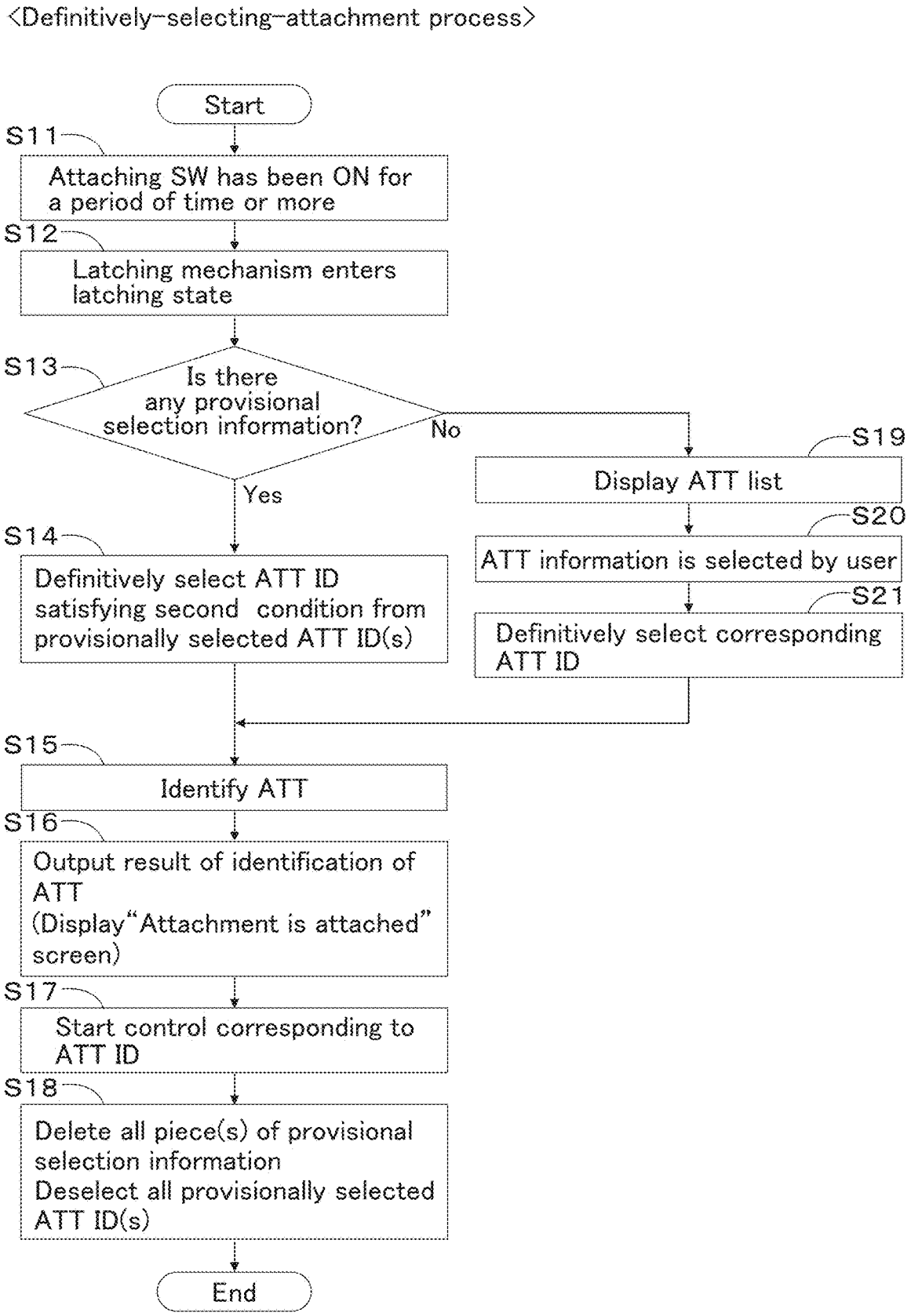
FIG. 11 is a flowchart showing an example of a definitively-selecting-attachment process.

FIG. 11 is a flowchart showing an example of a definitively-selecting-attachment process. For example, the user operates the operator(s) 6 and/or 7 to actuate the traveling devices 5 and/or the working device 4 to cause the quick hitch 16 to hold the attachment 30, and then operates (turns ON) the attaching switch 26 continuously for a predetermined period of time or more (S11). With this, the controller 21 causes the latch cylinder 52 to extend to bring the latching mechanisms 51 into the latching state (S12), so that the attachment 30 is attached to the quick hitch 16 and the working vehicle 1.

The controller 21 reads content stored in the nonvolatile memory 22 and, if the nonvolatile memory 22 stores any provisional selection information (YES in S13), reads the provisional selection information and definitively selects an attachment ID that satisfies the second condition (S14).

The second condition may be condition(s) relating to the RSSI of an advertisement signal Q1. For example, the second condition may be a condition in which the attachment ID corresponds to the highest one of the RSSI(s) included in piece(s) of provisional selection information stored in the nonvolatile memory 22.

Alternatively, the second condition may be condition(s) relating to the number of attachment IDs. For example, the second condition may be (i) a condition in which the attachment ID is one of the attachment ID(s) included in the piece(s) of provisional selection information stored in the nonvolatile memory 22 that has been received most (the number of attachment IDs is the largest), (ii) a condition in which the attachment ID is the most recently received attachment ID of the attachment ID(s) included in the piece(s) of provisional selection information stored in the nonvolatile memory 22, and/or (iii) a condition in which the attachment ID is the most recently received attachment ID which has been received consecutively a predetermined number of times or more, of the attachment ID(s) included in the piece(s) of provisional selection information stored in the nonvolatile memory 22.

The second condition may be a combination of any of the above conditions. The conditions described above are examples, and the second condition may be some other condition(s). In a case that only a single piece of provisional selection information is stored in the nonvolatile memory 22, there is also only a single provisionally selected attachment ID. In such a case, the controller 21 may definitively select this attachment ID.

The controller 21, after definitively selecting an attachment ID (S14), identifies (recognizes) the attachment 30 attached to the quick hitch 16 based on the attachment ID (S15). In so doing, the controller 21 identifies the type and other specifications, etc. of the attachment 30 attached to the quick hitch 16 based on the definitively selected attachment ID.

Next, the controller 21 causes the nonvolatile memory 22 to store the result of identification of the attachment 30, and causes the user interface 25 to display (output) the result of identification (S16, predetermined process). In so doing, the controller 21 causes the user interface 25 to display an "attachment is attached" screen G1 indicating that the attachment 30 corresponding to the definitively selected attachment ID is attached and showing attachment information relating to the attached attachment 30.

Figure 12:
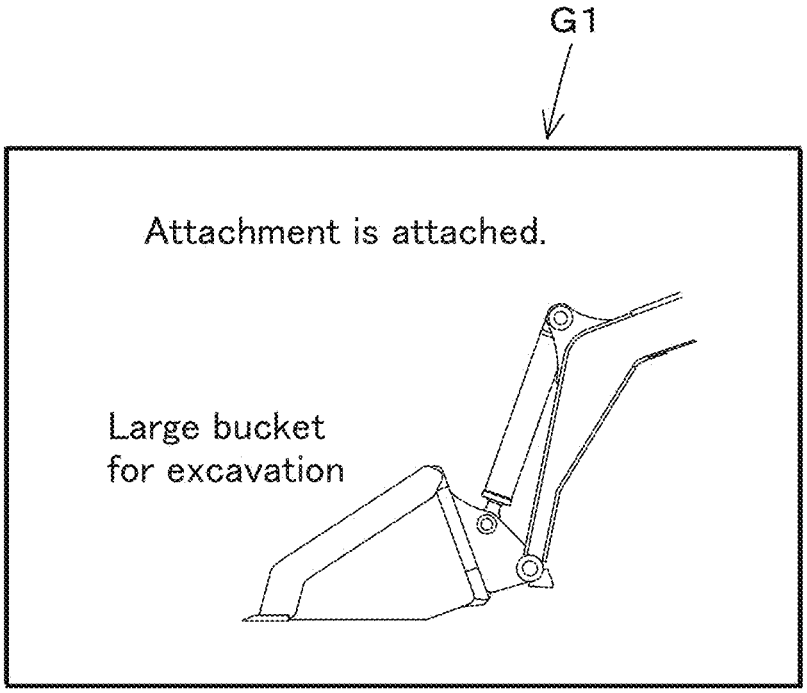
FIG. 12 illustrates an example of an "attachment is attached" screen.

FIG. 12 illustrates an example of the "attachment is attached" screen G1. The "attachment is attached" screen G1 displays a message indicating that the attachment 30 is attached, the attachment information relating to the attached attachment 30, and an icon of the attachment 30. In the example in FIG. 12, the attachment information "Large bucket" "for excavation" is displayed. Additionally or alternatively, other attachment information such as the attachment ID, size, and/or manufacturer of the attachment 30 may be displayed. The display data for the "attachment is attached" screen G1 and the attachment information are prestored in the nonvolatile memory 22 (FIG. 5).

For another example, the controller 21 may cause the communicator 24 (FIG. 1) to transmit, to the portable device 70, the display data for the "attachment is attached" screen G1 and the attachment information relating to the attachment 30 which has been determined as being attached so that the "attachment is attached" screen G1 is displayed on a display of the portable device 70.

The controller 21 starts a predetermined control (predetermined process) according to the definitively selected attachment ID (S17). In so doing, the controller 21 reads control data (FIG. 6) corresponding to the definitively selected attachment ID form the nonvolatile memory 22 and starts control corresponding to the attachment 30 attached to the quick hitch 16 based on the control data.

Specifically, in the case where the attachment 30 attached to the quick hitch 16 is an attachment 30*b* including a hydraulic actuator such as a skid cutter, the controller 21 starts causing the control valve 40*d* to control the output of hydraulic fluid from the hydraulic fluid outlet port 18*a* to the attachment 30*b*, based on the control data read from the nonvolatile memory 22. With this, draining of return fluid to be introduced from the attachment 30*b* into the hydraulic fluid inlet port 18*b* is also started. The controller 21 may, for example, cause the "attachment is attached" screen G1 to display a message indicating that the control of the output of hydraulic fluid to the attachment 30*b* has been started.

Note that, in the case where the attachment 30 attached to the quick hitch 16 is an attachment 30 including no hydraulic actuators such as a bucket 30*a*, the controller 21 does not cause the control valve 40*d* to output hydraulic fluid from the hydraulic fluid outlet port 18*a* to the attachment 30 based on the control data read from the nonvolatile memory 22. The controller 21 may start control such as adjusting and/or limiting the travel speed and/or speed stage of the working vehicle 1 and/or the height of the raised/lowered booms 11 according to the definitively selected attachment ID in step S17.

The controller 21 deletes all piece(s) of provisional selection information stored in the nonvolatile memory 22 to deselect all the provisionally selected attachment ID(s) (S18). For another example, the controller 21 may be configured or programmed to, after step S17, keep the piece(s) of provisional selection information stored in the nonvolatile memory 22 and then, when the detaching switch 27 is operated for a period of time or more to detach the attachment 30 from the quick hitch 16, delete all the piece(s) of provisional selection information from the nonvolatile memory 22. In so doing, the controller 21 may stop (end) a predetermined control (predetermined process) corresponding to the definitively selected attachment ID and deselect the definitively selected attachment ID.

On the contrary, if no provisional selection information is stored in the nonvolatile memory 22 (NO in S13), the controller 21 causes the user interface 25 to display an attachment list L1 indicating one or more attachments 30 attachable to the quick hitch 16 (S19).

FIG. 13 shows an example of the attachment list L1. The nonvolatile memory 22 stores data of the attachment list L1. The attachment list L1 displayed by the user interface 25 includes, for example, attachment information such as name(s), attachment ID(s), and specifications of the attachment(s) 30 attachable to the quick hitch 16.

The user selects a piece of attachment information relating to the attachment 30 attached to the quick hitch 16 from the attachment list L1 via the user interface 25 (S20). With this, the controller 21 definitively selects the attachment ID corresponding to the selected piece of attachment information (S21), and performs steps S15 to S18 as described earlier.

For example, the controller 21 may cause the user interface 25 to display, in a selectable manner, icon(s) (symbol(s)) of the attachment(s) 30 attachable to the quick hitch 16, instead of displaying the attachment list L1 in step S19. Alternatively, for example, the controller 21 may cause the user interface 25 to display an input screen to receive input of attachment information such as an attachment ID.

When causing the user interface 25 to display the attachment list L1, the icon(s) of the attachment 30, or the input screen for attachment information, the controller 21 may cause the user interface 25 to also display a prompt message asking for selection or input of the attachment 30 attached to the quick hitch 16.

Figure 14:
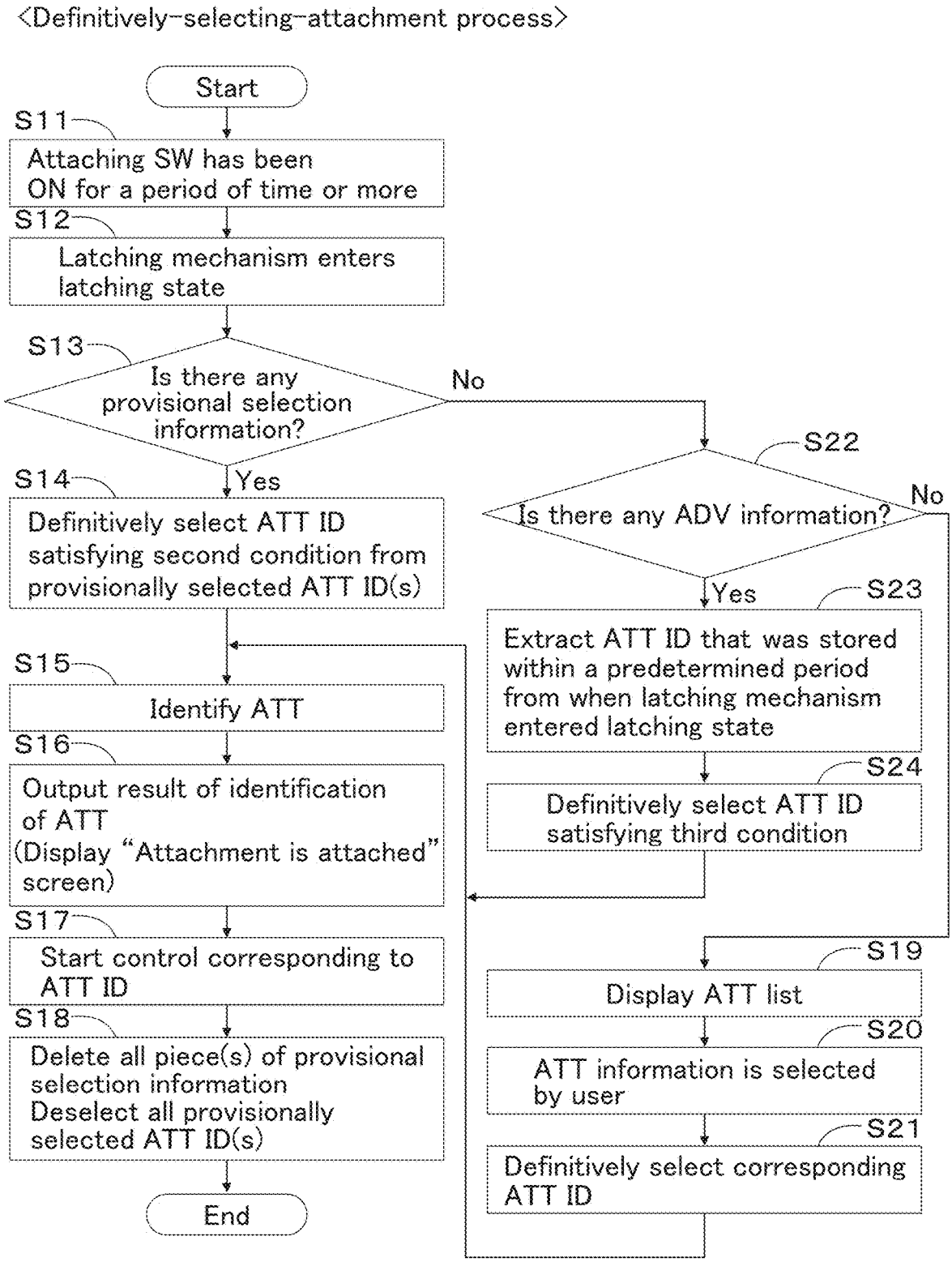
FIG. 14 is a flowchart showing another example of the definitively-selecting-attachment process.

For another example, if no provisional selection information is stored in the nonvolatile memory 22, the controller 21 may definitively select one of the attachment ID(s) included in piece(s) of ADV information (FIG. 3) stored in the internal memory 21*a*, as shown in FIG. 14.

Specifically, if no provisional selection information is stored in the nonvolatile memory 22 (NO in S13 in FIG. 14), the controller 21 determines whether or not the internal memory 21*a* stores ADV information. If the internal memory 21*a* stores ADV information (YES in S22), the controller 21 reads the time information and the attachment ID included in each piece of ADV information, and extracts attachment ID(s) that was/were stored in the internal memory 21*a* during a predetermined period of time (a past predetermined period of time, for example, about 30 seconds) which ended when the latching mechanisms 51 entered the latching state (S23).

Next, the controller 21 definitively selects an attachment ID that satisfies a third condition from the extracted attachment ID(s) (S24). The third condition is predetermined condition(s) relating to the RSSI, time information, attachment ID, etc. included in a corresponding piece of ADV information. For example, the third condition may be (i) a condition in which the attachment ID is the highest in terms of RSSI and/or (ii) the attachment ID has been received the largest number of times. The third condition may also include a condition in which, for example, if there are two or more different attachment IDs which are the highest in terms of RSSI or in terms of the number of times of reception, the attachment ID is one of the two or more different attachment IDs that has most recently been received. As such, the third condition may be a combination of two or more conditions. After definitively selecting the attachment ID which satisfies the third condition (S24), the controller 21 performs steps S15 to S18 as described earlier. That is, the controller 21 performs a predetermined process based on the definitively selected attachment ID.

Figure 15A:
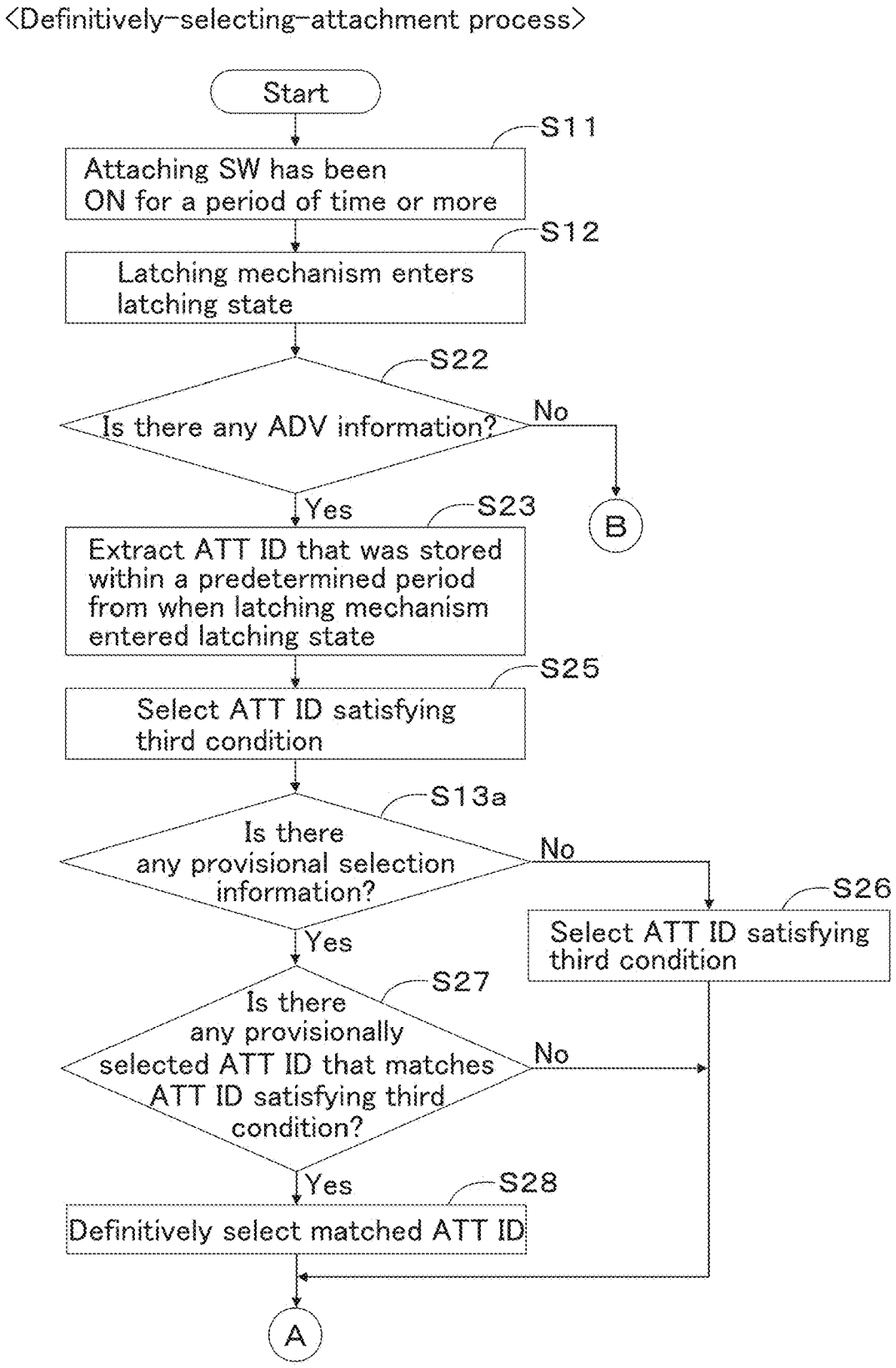
FIG. 15A is a flowchart showing a further example of the definitively-selecting-attachment process.
Figure 15B:
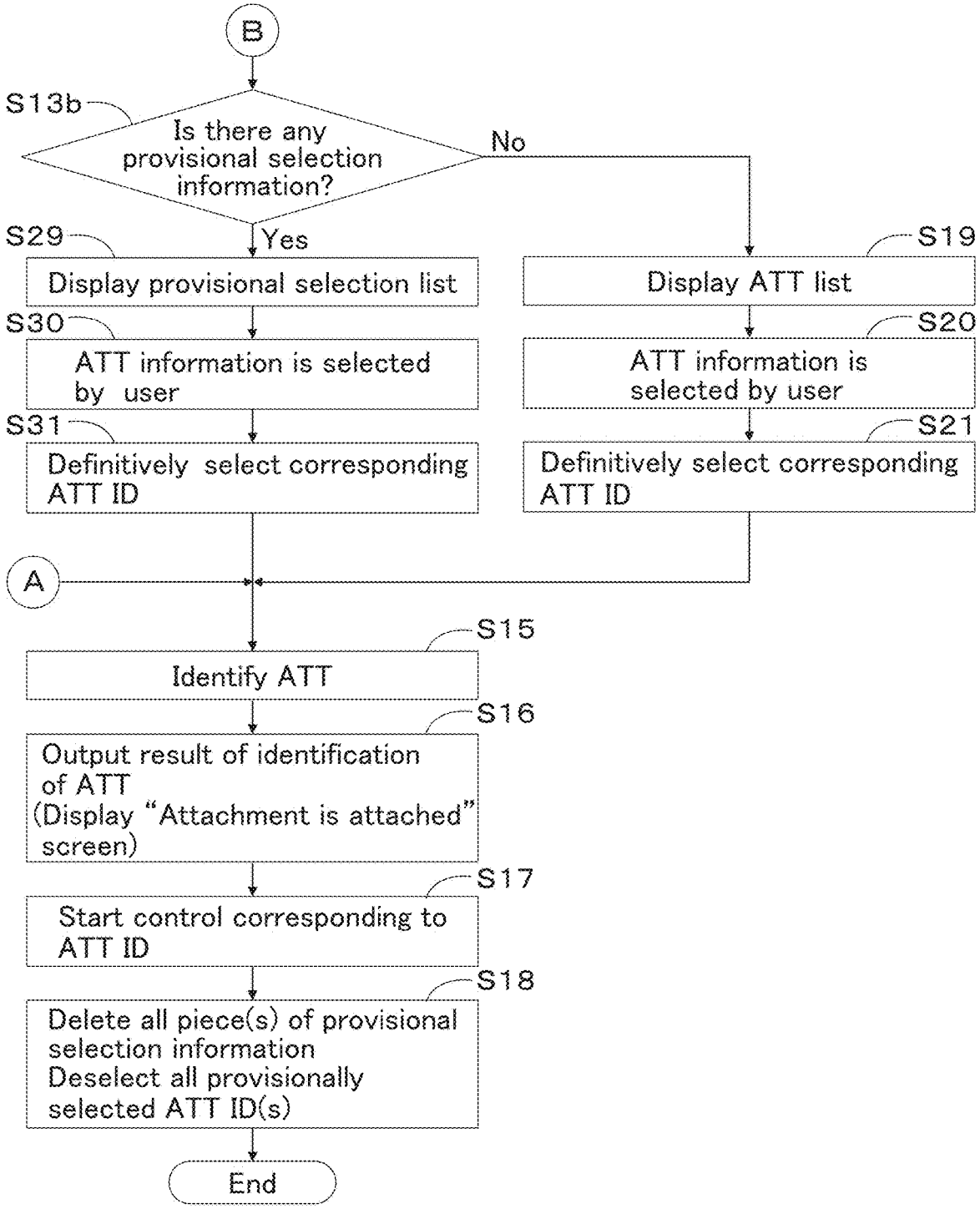
FIG. 15B is a flowchart continuing from FIG. 15A.

For another example, the controller 21 may definitively select an attachment ID as shown in FIGS. 15A and 15B. In the example embodiment in FIGS. 15A and 15B, the controller 21 determines whether or not the internal memory 21*a* stores ADV information after step S12. If the internal memory 21*a* stores ADV information (YES in S22 in FIG. 15A), the controller 21 extracts, from the piece(s) of ADV information, attachment ID(s) that was/were stored in the internal memory 21*a* during a predetermined period of time which ended when the latching mechanisms 51 entered the latching state (S23), and selects an attachment ID that satisfies the third condition from the extracted attachment ID(s) (S25).

Next, if no provisional selection information is stored in the nonvolatile memory 22 (NO in S13*a*), the controller 21 definitively selects an attachment ID that satisfies the third condition (S26), and performs steps S15 to S18 (in FIG. 15B) as described earlier. That is, the controller 21 performs a predetermined process based on the definitively selected attachment ID.

If the nonvolatile memory 22 stores provisional selection information (YES in S13*a* in FIG. 15A), the controller 21 reads the provisionally selected attachment ID(s) included in the piece(s) of provisional selection information. Next, if any of the provisionally selected attachment ID(s) matches the attachment ID that satisfies the third condition (YES in S27), the controller 21 definitively selects the attachment ID that matches the attachment ID satisfying the third condition (S28). Specifically, in the example in FIGS. 15A and 15B, an attachment ID is definitively selected if the following condition is satisfied (such a condition is the second condition in a case that an attachment ID satisfying the third condition is selected, and may be referred to as a fourth condition): the attachment ID is a provisionally selected attachment ID which matches the attachment ID satisfying the third condition. After definitively selecting the attachment ID, the controller 21 performs steps S15 to S18.

If none of the provisionally selected attachment ID(s) match the attachment ID satisfying the third condition (NO in S27), the controller 21 definitively selects the attachment ID that satisfies the third condition (S26), and performs steps S15 to S18.

If no ADV information is stored in the internal memory 21*a* (NO in S22), the controller 21 cannot select any attachment ID that satisfies the third condition. In such a case, if the nonvolatile memory 22 stores provisional selection information (YES in S13*b* in FIG. 15B), the controller 21 causes the user interface 25 to display a provisional selection list L2 indicating attachment(s) 30 corresponding to the provisionally selected attachment ID(s) included in the piece(s) of provisional selection information (S29).

FIG. 16 illustrates an example of the provisional selection list L2. The provisional selection list L2 displayed by the user interface 25 includes attachment information such as name(s), attachment ID(s), and specifications of attachment(s) 30 corresponding to the provisionally selected attachment ID(s) (provisionally selected attachment(s)).

The user selects a piece of attachment information relating to the attachment 30 attached to the quick hitch 16 from the provisional selection list L2 via the user interface 25 (S30 in FIG. 15B). With this, the controller 21 definitively selects the attachment ID corresponding to the selected piece of attachment information (S31), and performs steps S15 to S18 as described earlier. That is, the controller 21 performs a predetermined process based on the definitively selected attachment ID.

The controller 21 may cause the user interface 25 to display icon(s) of the attachment(s) 30 corresponding to the provisionally selected attachment ID(s), instead of displaying the provisional selection list L2 in step S29. When causing the user interface 25 to display the provisional selection list L2 or the icon(s), the controller 21 may cause the user interface 25 to also display a prompt message asking for selection or input of the attachment 30 attached to the quick hitch 16.

If no ADV information is stored in the internal memory 21*a* (NO in S22 in FIG. 15A) and no provisional selection information is stored in the nonvolatile memory 22 (NO in S13*b* in FIG. 15B), the controller 21 performs steps S19 to S21 and steps S15 to S18 as described earlier.

For another example, the controller 21 may be configured or programmed to, before performing step S26 in FIG. 15A, cause the user interface 25 to display a piece of attachment information that corresponds to the attachment ID satisfying the third condition and cause the user interface 25 to also display information asking whether the piece of attachment information corresponds to the attachment 30 attached to the quick hitch 16. The controller 21 may be configured or programmed to, if the user inputs response information indicating that the piece of attachment information corresponds to the attachment 30 attached to the quick hitch 16 via the user interface 25, definitively select the attachment ID satisfying the third condition.

If the controller 21 fails to select any of the attachment ID(s) that satisfies the third condition in step S25 in FIG. 15A, the controller 21 may proceed to step S13*b* in FIG. 15B and perform steps S29 to S31 or steps S19 to S21 depending on whether there is provisional selection information or not. The controller 21 may definitively select an attachment ID satisfying the foregoing second condition (which is the same as that in step S14 in FIG. 11 and is the second condition in a case that no attachment IDs satisfying the third condition are selected, and may be referred to as a fifth condition) from the provisionally selected attachment ID(s) included in the piece(s) of provisional selection information, instead of steps S29 to S31.

In the example embodiments described above, the controller 21 causes the internal memory 21*a* to store, as ADV information, information included in advertisement signal(s) Q1 received by the beacon scanner 23, etc. Note, however, that the controller 21 may cause the internal memory 21*a* to store, as ADV information, only information included in one or more of the received advertisement signal(s) Q1 that satisfy a predetermined condition together with time information and/or the like. The predetermined condition may be the same as or different from the first condition.

In the example embodiments described above, the controller 21 causes the internal memory 21*a* to store ADV information and causes the nonvolatile memory 22 to store provisional selection information. Note, however, that ADV information and provisional selection information may be stored in a single memory. Such memory (memories) may be provided inside and/or outside the controller 21.

In the above-described example embodiments, each attachment 30 is provided with a beacon transmitter 33 to transmit a wireless signal (advertisement signal Q1) compliant with Bluetooth (registered trademark) Low Energy, and the working vehicle 1 is provided with a beacon scanner 23 to receive the wireless signals. However, additionally or alternatively, for example, the attachment 30 may be provided with a transmitter such as a radio frequency identification (RFID) tag, and the working vehicle 1 may be provided with a receiver to receive wireless signals transmitted from the RFID. Additionally or alternatively, the attachment 30 may be provided with a transmitter to transmit radio waves for some other near field communication, and the working vehicle 1 may be provided with a receiver to receive the radio waves.

In the above-described example embodiments, the working vehicle 1 is provided with the quick hitch 16. Alternatively, the working vehicle 1 may be provided with a hitch having a different structure from the quick hitch 16, a quick hitch to which an attachment 30 can be attached and detached both automatically and manually, or a hitch to which an attachment 30 can be attached and detached only manually. In the case where the user manually attaches the attachment 30 to the hitch or manually detaches the attachment 30 from the hitch, the user may input information indicating that the attachment 30 is attached or detached using the user interface 25.

In the above-described example embodiments, the user inputs attachment information relating to the attachment 30 attached to the quick hitch 16 using the user interface 25 provided in or on the working vehicle 1. However, for example, the user may input attachment information relating to the attachment 30 attached to the quick hitch 16 using a portable device 70. That is, the portable device 70 may be used as a user interface instead of the user interface 25.

In such a case, upon input of attachment information into the portable device 70, the portable device 70 transmits the attachment information to the communicator 24 of the working vehicle 1 via the Internet and/or the like. The controller 21 of the working vehicle 1 may, upon receipt of the attachment information by the communicator 24, definitively select the attachment ID corresponding to the attachment information.

The controller 21 may use the portable device 70 provided external to the working vehicle 1 or the like as an output, instead of the user interface 25 of the working vehicle 1. In such a case, the controller 21 need only cause the communicator 24 to transmit information to the output external to the working vehicle 1 and cause the output to output the information. A controller such as an information processor external to the working vehicle 1 may perform similar processes to the controller 21. That is, the controller and the output of the attachment usage system 100 may be provided somewhere other than the working vehicle 1.

In the above-described example embodiments, the working device 4, the quick hitch 16, and the specific attachment 30*b* are provided with hydraulic actuators (such as the boom cylinders 14, the front cylinders 15, and the latch cylinder 52). Additionally or alternatively, the working device 4, the quick hitch 16, and the specific attachment may be provided with other actuators such as electric actuators including electric motors or hydraulic actuators other than the hydraulic cylinders. In the case where an attachment including an electric actuator is attached to the quick hitch 16, the controller 21 may output, as power for the electric actuator, electricity (power) from the battery 20 (FIG. 1) to the attachment via an external electric wire based on control data corresponding to the attachment.

An attachment including a work member to be actuated by power from the prime mover 9 of the working vehicle 1 may be attached to the quick hitch 16. In the case where such an attachment including a work member is attached to the quick hitch 16, the controller 21 may output power from the prime mover 9 to the attachment via a power transmission mechanism including gear(s), shaft(s), and/or the like based on control data corresponding to the attachment.

A working vehicle 1 according to one or more example embodiments as has been described includes a traveling device 5 and a working device 4 which are on a vehicle body 2, a hitch (quick hitch) 16 connected to the working device 4 to attach and detach an attachment 30 thereto and therefrom, a receiver (beacon scanner) 23 to receive one or more wireless signals (advertisement signals) Q1 which: (i) are transmitted periodically from one or more transmitters (beacon transmitters) 33 in or on one or more of the attachments 30, (ii) include respective one or more pieces of identification information relating to the one or more attachments 30, and (iii) are compliant with a near field communication standard, and a controller 21.

An attachment usage system 100 according to one or more example embodiments as has been described is a system to use one or more attachments 30 on a working vehicle 1, and includes the traveling device 5, the working device 4, the hitch 16, the transmitter 33, the receiver 23, and the controller 21.

The hitch 16 includes a latching mechanism 51 selectively operable in a latching state in which the attachment 30 is secured to the hitch 16 or an unlatching state in which the attachment 30 is not secured to the hitch 16, and the controller 21 is configured or programmed to, while the latching mechanism 51 is in the unlatching state and at least one of the traveling device 5 or the working device 4 is about to take action or is in action, select one or more wireless signals Q1 which satisfy a first condition from the one or more wireless signals Q1 received by the receiver 23, and provisionally select one or more pieces of identification information (attachment IDs) of the one or more pieces of identification information that are included in the selected one or more wireless signals Q1, and once the latching mechanism 51 has entered the latching state, definitively select a piece of identification information which satisfies a second condition from the provisionally selected one or more pieces of identification information, and start a predetermined process based on the definitively selected piece of identification information.

With the above configuration, when the traveling devices 5 and/or the working device 4 is/are about to be actuated or being actuated to attach an attachment 30 to the hitch 16 of the working vehicle 1, the receiver 23 receives wireless signal(s) transmitted from transmitter(s) 33 in or on attachment(s) 30 in the vicinity of the working vehicle 1. Then, piece(s) of identification information relating to attachment(s) 30 included in wireless signal(s) that satisfy the first condition, of the received wireless signal(s), is/are provisionally selected as piece(s) of identification information relating to attachment(s) 30 which may possibly be attached. After that, when an attachment 30 is attached to the hitch 16, a piece of identification information that satisfies the second condition is definitively selected as a piece of identification information relating to the attached attachment 30 from the provisionally selected piece(s) of identification information, and a predetermined process corresponding to the definitively selected piece of identification information is started on the working vehicle 1.

Therefore, even if, when an attachment 30 is attached to the hitch 16, the attachment 30 and the hitch 16 vibrate unusually or the wireless signal from the transmitter 33 is temporarily blocked by the attachment 30, the hitch 16, and the working device 4, etc. and is hardly received by the receiver 23, it is still possible for the working vehicle 1 to perform a predetermined process corresponding to the attachment 30 attached to the hitch 16, and thus possible to appropriately use the attachment 30. It is also possible to eliminate or reduce the likelihood that the working vehicle 1 will accidentally perform a predetermined process based on an attachment 30 in the vicinity of the working vehicle 1 but not attached to the hitch 16.

In one or more example embodiments, the controller 21 may be configured or programmed to, while the latching mechanism 51 is in the unlatching state, if the receiver 23 does not receive the one or more wireless signals Q1 which satisfy the first condition and which include the provisionally selected one or more pieces of identification information for a predetermined period of time or more, deselect the provisionally selected one or more pieces of identification information.

With this, even if a piece of identification information included in a wireless signal transmitted from a transmitter 33 in or on an attachment 30 in the vicinity of the working vehicle 1 but not attached to the hitch 16 and received by the receiver 23 is provisionally selected, it is possible to eliminate or reduce the likelihood that this piece of identification information will be definitively selected, and also possible to eliminate or reduce the likelihood that the working vehicle 1 will accidentally perform a predetermined process based on this piece of identification information.

In one or more example embodiments, the controller 21 may be configured or programmed to, while the latching mechanism 51 is in the unlatching state and an action speed of the traveling device 5 is equal to or greater than a predetermined value, if the receiver does not receive the one or more wireless signals which satisfy the first condition and which include the provisionally selected one or more pieces of identification information for a predetermined period of time or more, deselect the provisionally selected one or more pieces of identification information.

With this, even if a piece of identification information included in a wireless signal transmitted from a transmitter 33 in or on an attachment 30 in the vicinity of the working vehicle 1 but not attached to the hitch 16 and received by the receiver 23 is provisionally selected, as the working vehicle 1 moves away from the attachment 30, the wireless signal becomes a signal that does not satisfy the first condition, so that the provisionally selected piece of identification information included in the wireless signal is deselected. This makes it possible to eliminate or reduce the likelihood that this piece of identification information relating to the attachment 30 not attached to the hitch 16 will be definitively selected, and also possible to eliminate or reduce the likelihood that the working vehicle 1 will accidentally perform a predetermined process based on this piece of identification information.

In one or more example embodiments, the controller 21 may be configured or programmed to, if the provisionally selected one or more pieces of identification information include only a single piece of identification information, definitively select the single piece of identification information once the latching mechanism 51 has entered the latching state.

With this, a process of determining whether or not the provisionally selected piece(s) of identification information satisfies the second condition is skipped. This makes it possible for the working vehicle 1 to quickly start a predetermined process corresponding to the attachment 30 attached to the hitch 16.

In one or more example embodiments, the controller 21 may be configured or programmed to cause a memory (internal memory) 21*a* to store the one or more pieces of identification information included in the one or more wireless signals Q1 received by the receiver 23, and once the latching mechanism 51 has entered the latching state, select a piece of identification information which satisfies a third condition from one or more of the one or more pieces of identification information that were stored in the memory 21*a* during a predetermined period of time which ended when the latching mechanism 51 entered the latching state, and, if the selected piece of identification information matches one of the provisionally selected one or more pieces of identification information, start the predetermined process based on the one of the provisionally selected one or more pieces of identification information.

With this, the provisionally selected piece of identification information that matches a piece of identification information satisfying the third condition is definitively selected from the piece(s) of identification information included in the wireless signal(s) received by the receiver 23 when the attachment 30 is attached to the hitch 16 or immediately before the attachment 30 is attached to the hitch 16. This makes it possible to definitively select the piece of identification information relating to the attachment 30 attached to the hitch 16 accurately and possible for the working vehicle 1 to appropriately start the predetermined process based on the piece of identification information.

In one or more example embodiments, the controller 21 may be configured or programmed to, if the selected piece of identification information which satisfies the third condition does not match any of the provisionally selected one or more pieces of identification information, start the predetermined process based on the selected piece of identification information which satisfies the third condition.

With this, even if a piece of identification information included in a wireless signal transmitted from a transmitter 33 in or on an attachment 30 in the vicinity of the working vehicle 1 but not attached to the hitch 16 and received by the receiver 23 is provisionally selected, it is possible to eliminate or reduce the likelihood that this piece of identification information will be definitively selected. Furthermore, since the piece of identification information that satisfies the third condition is definitively selected from the piece(s) of identification information included in the wireless signal(s) received by the receiver 23 when the attachment 30 is attached to the hitch 16 or immediately before the attachment 30 is attached to the hitch 16, it is possible to appropriately start the predetermined process based on the piece of identification information relating to the attachment 30 attached to the hitch 16.

In one or more example embodiments, the controller 21 may be configured or programmed to, if the controller 21 fails to select any piece of identification information which satisfies the third condition, definitively select a piece of identification information which satisfies the second condition from the provisionally selected one or more pieces of identification information.

With this, even if, when the attachment 30 is attached to the hitch 16 or immediately before the attachment 30 is attached to the hitch 16, the wireless signal from the transmitter 33 in or on the attachment 30 is blocked by the attachment 30, the hitch 16, and the working device 4, etc. and stops being received by the receiver 23 temporarily, it is possible to definitively select the piece of identification information relating to the attachment 30 attached to the hitch 16 and possible to appropriately perform the predetermined process based on the piece of identification information.

In one or more example embodiments, the working vehicle 1 may further include a user interface 25. In one or more example embodiments, the controller 21 may be configured or programmed to, if the controller 21 fails to select any piece of identification information which satisfies the third condition, cause the user interface 25 to output one or more pieces of attachment information relating to one or more of the one or more attachments 30 that correspond to the provisionally selected one or more pieces of identification information, and once a piece of attachment information has been selected from the one or more pieces of attachment information via the user interface 25, start the predetermined process based on the selected piece of attachment information.

With this, even if, when the attachment 30 is attached to the hitch 16 or immediately before the attachment 30 is attached to the hitch 16, the wireless signal from the transmitter 33 in or on the attachment 30 is blocked by the attachment 30, the hitch 16, and the working device 4, etc. and stops being received by the receiver 23 temporarily, it is possible to appropriately perform the predetermined process based on the piece of identification information selected via the user interface 25 by a user such as a user of the working vehicle 1 from the piece(s) of identification information provisionally selected as those of the attachment(s) 30 which may possibly be attached.

In one or more example embodiments, the controller 21 may be configured or programmed to, once the latching mechanism 51 has entered the latching state when none of the one or more pieces of identification information are provisionally selected, select a piece of identification information which satisfies a third condition from one or more of the one or more pieces of identification information that were stored in the memory 21*a* during a predetermined period of time which ended when the latching mechanism 51 entered the latching state, and start the predetermined process based on the selected piece of identification information.

With this, even if it is not possible to provisionally select any piece of identification information relating to an attachment 30, since the piece of identification information that satisfies the third condition is definitively selected from piece(s) of identification information included in the wireless signal(s) received by the receiver 23 when the attachment 30 is attached to the hitch 16 or immediately before the attachment 30 is attached to the hitch 16, it is possible to appropriately start the predetermined process based on the piece of identification information relating to the attachment 30 attached to the hitch 16.

In one or more example embodiments, the controller 21 may be configured or programmed to, once the latching mechanism 51 has entered the latching state when none of the one or more pieces of identification information are provisionally selected and the controller 21 has failed to select any piece of identification information which satisfies the third condition from one or more of the one or more pieces of identification information that were stored in the memory 21*a* during the predetermined period of time which ended when the latching mechanism 51 entered the latching state, cause the user interface 25 to output prompt information asking for input of a piece of attachment information relating to the attachment 30 attached to the hitch 16, and once the piece of attachment information has been inputted via the user interface 25, start the predetermined process based on the inputted piece of attachment information.

With this, even if the wireless signal from the transmitter 33 in or on the attachment 30 is blocked by the attachment 30, the hitch 16, and the working device 4, etc. and stops being received by the receiver 23 temporarily, it is possible to appropriately perform the predetermined process based on the piece of identification information designated via the user interface 25 by a user such as the user of the working vehicle 1.

In one or more example embodiments, the working vehicle 1 may further include a work operator 7 to be operated to actuate the working device 4. The controller 21 may be configured or programmed to provisionally select the one or more pieces of identification information if (i) the latching mechanism 51 is in the unlatching state and (ii) the work operator 7 is operated for a period of time or more and/or the working device 4 is in action for the period of time or more.

With this, it is possible to provisionally select a piece of identification information relating to the attachment 30 included in a wireless signal transmitted from the transmitter 33 in or on the attachment 30 and received by the receiver 23 when the working device 4 is being actuated to attach the attachment 30 to the hitch 16.

In one or more example embodiments, the working vehicle 1 may further include a travel operator 6 to be operated to actuate the traveling device 5. The controller 21 may be configured or programmed to provisionally select the one or more pieces of identification information if (i) the latching mechanism 51 is in the unlatching state and (ii) the travel operator 6 is operated for a period of time or more and/or the traveling device 5 is in action for the period of time or more.

With this, it is possible to provisionally select a piece of identification information relating to the attachment 30 included in a wireless signal transmitted from the transmitter 33 in or on the attachment 30 and received by the receiver 23 when the traveling device(s) 5 is/are being actuated to attach the attachment 30 to the hitch 16.

In one or more example embodiments, the controller 21 may be configured or programmed to provisionally select the one or more pieces of identification information if (i) the latching mechanism 51 is in the unlatching state and (ii) at least one of the traveling device 5 or the working device 4 is performing a predetermined action to attach the attachment 30 to the hitch 16.

With this, it is possible to provisionally select a piece of identification information relating to the attachment 30 about to be attached to the hitch 16 included in a wireless signal transmitted from the transmitter 33 in or on the attachment 30 and received by the receiver 23.

In one or more example embodiments, each of the one or more transmitters 33 may be a beacon transmitter to transmit an advertisement signal Q1 including a corresponding piece of identification information relating to a corresponding attachment 30 in or on which the transmitter 33 is provided. The receiver 23 may be a beacon scanner to receive the advertisement signal Q1.

With this, it is possible to easily select the piece of identification information relating to the attachment 30 attached to the hitch 16 of the working vehicle 1 via a one-way communication from a versatile beacon transmitter 33 to the beacon scanner 23 and immediately start a predetermined process based on the piece of identification information.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working vehicle comprising:

a traveling device and a working device which are on a vehicle body;

a hitch connected to the working device to attach and detach an attachment thereto and therefrom;

a receiver to receive one or more wireless signals which are: (i) transmitted periodically from one or more transmitters in or on one or more of the attachments, (ii) include respective one or more pieces of identification information relating to the one or more attachments, and (iii) are compliant with a near field communication standard; and a controller; wherein the hitch includes a latching mechanism selectively operable in a latching state in which the attachment is secured to the hitch or an unlatching state in which the attachment is not secured to the hitch; and the controller is configured or programmed to:

while the latching mechanism is in the unlatching state and at least one of the traveling device or the working device is about to take action or is in action, select one or more wireless signals which satisfy a first condition from the one or more wireless signals received by the receiver, and provisionally select one or more pieces of identification information of the one or more pieces of identification information that are included in the selected one or more wireless signals; and once the latching mechanism has entered the latching state, definitively select a piece of identification information, which satisfies a second condition, from the provisionally selected one or more pieces of identification information, and start a predetermined process based on the definitively selected piece of identification information.

2. The working vehicle according to claim 1, wherein the controller is configured or programmed to, while the latching mechanism is in the unlatching state, if the receiver does not receive the one or more wireless signals which satisfy the first condition and which include the provisionally selected one or more pieces of identification information for a predetermined period of time or more, deselect the provisionally selected one or more pieces of identification information.

3. The working vehicle according to claim 1, wherein the controller is configured or programmed to, while the latching mechanism is in the unlatching state and an action speed of the traveling device is equal to or greater than a predetermined value, if the receiver does not receive the one or more wireless signals which satisfy the first condition and which include the provisionally selected one or more pieces of identification information for a predetermined period of time or more, deselect the provisionally selected one or more pieces of identification information.

4. The working vehicle according to claim 1, wherein the controller is configured or programmed to, if the provisionally selected one or more pieces of identification information include only a single piece of identification information, definitively select the single piece of identification information once the latching mechanism has entered the latching state.

5. The working vehicle according to claim 1, wherein the controller is configured or programmed to:

cause a memory to store the one or more pieces of identification information included in the one or more wireless signals received by the receiver; and once the latching mechanism has entered the latching state, select a piece of identification information which satisfies a third condition from one or more of the one or more pieces of identification information that were stored in the memory during a predetermined period of time which ended when the latching mechanism entered the latching state, and, if the selected piece of identification information matches one of the provisionally selected one or more pieces of identification information, start the predetermined process based on the one of the provisionally selected one or more pieces of identification information.

6. The working vehicle according to claim 5, wherein the controller is configured or programmed to, if the selected piece of identification information which satisfies the third condition does not match any of the provisionally selected one or more pieces of identification information, start the predetermined process based on the selected piece of identification information which satisfies the third condition.

7. The working vehicle according to claim 5, wherein the controller is configured or programmed to, if the controller fails to select any piece of identification information which satisfies the third condition, definitively select a piece of identification information which satisfies the second condition from the provisionally selected one or more pieces of identification information.

8. The working vehicle according to claim 5, further comprising a user interface; wherein the controller is configured or programmed to:

if the controller fails to select any piece of identification information which satisfies the third condition, cause the user interface to output one or more pieces of attachment information relating to one or more of the one or more attachments that correspond to the provisionally selected one or more pieces of identification information; and once a piece of attachment information has been selected from the one or more pieces of attachment information via the user interface, start the predetermined process based on the selected piece of attachment information.

9. The working vehicle according to claim 1, wherein the controller is configured or programmed to:

cause a memory to store the one or more pieces of identification information included in the one or more wireless signals received by the receiver; and once the latching mechanism has entered the latching state when none of the one or more pieces of identification information are provisionally selected, select a piece of identification information which satisfies a third condition from one or more of the one or more pieces of identification information that were stored in the memory during a predetermined period of time which ended when the latching mechanism entered the latching state, and start the predetermined process based on the selected piece of identification information.

10. The working vehicle according to claim 9, further comprising a user interface; wherein the controller is configured or programmed to:

once the latching mechanism has entered the latching state when none of the one or more pieces of identification information are provisionally selected and the controller has failed to select any piece of identification information which satisfies the third condition from one or more of the one or more pieces of identification information that were stored in the memory during the predetermined period of time which ended when the latching mechanism entered the latching state, cause the user interface to output prompt information asking for input of a piece of attachment information relating to the attachment attached to the hitch; and once the piece of attachment information has been inputted via the user interface, start the predetermined process based on the inputted piece of attachment information.

11. The working vehicle according to claim 1, further comprising a work operator to be operated to actuate the working device; wherein the controller is configured or programmed to provisionally select the one or more pieces of identification information if (i) the latching mechanism is in the unlatching state and (ii) the work operator is operated for a period of time or more and/or the working device is in action for the period of time or more.

12. The working vehicle according to claim 1, further comprising a travel operator to be operated to actuate the traveling device; wherein the controller is configured or programmed to provisionally select the one or more pieces of identification information if (i) the latching mechanism is in the unlatching state and (ii) the travel operator is operated for a period of time or more and/or the traveling device is in action for the period of time or more.

13. The working vehicle according to claim 1, wherein the controller is configured or programmed to provisionally select the one or more pieces of identification information if (i) the latching mechanism is in the unlatching state and (ii) at least one of the traveling device or the working device is performing a predetermined action to attach the attachment to the hitch.

14. The working vehicle according to claim 1, wherein each of the one or more transmitters is a beacon transmitter to transmit an advertisement signal including a corresponding piece of identification information relating to a corresponding attachment in or on which the transmitter is provided; and the receiver is a beacon scanner to receive the advertisement signal.

15. An attachment usage system to use one or more attachments on a working vehicle, the attachment usage system comprising:

a traveling device and a working device which are on a vehicle body of the working vehicle;

a hitch connected to the working device to attach and detach an attachment thereto and therefrom;

one or more transmitters in or on one or more of the attachments to periodically transmit one or more wireless signals which include respective one or more pieces of identification information relating to the one or more attachments and which are compliant with a near field communication standard;

a receiver in or on the working vehicle to receive the one or more wireless signals transmitted from the one or more transmitters; and a controller; wherein the hitch includes a latching mechanism selectively operable in a latching state in which the attachment is secured to the hitch or an unlatching state in which the attachment is not secured to the hitch; and the controller is configured or programmed to:

while the latching mechanism is in the unlatching state and at least one of the traveling device or the working device is about to take action or is in action, select one or more wireless signals which satisfy a first condition from the one or more wireless signals received by the receiver, and provisionally select one or more pieces of identification information of the one or more pieces of identification information that are included in the selected one or more wireless signals; and once the latching mechanism has entered the latching state, definitively select a piece of identification information which satisfies a second condition from the provisionally selected one or more pieces of identification information, and start a predetermined process based on the definitively selected piece of identification information.

* * * * *